US011552399B2

(12) United States Patent
Kosaka et al.

(10) Patent No.: US 11,552,399 B2
(45) Date of Patent: Jan. 10, 2023

(54) SPLIT-RING RESONATOR, BOARD AND CONNECTOR

(71) Applicant: JAPAN AVIATION ELECTRONICS INDUSTRY, LIMITED, Tokyo (JP)

(72) Inventors: Keishi Kosaka, Tokyo (JP); Eiji Hankui, Tokyo (JP); Hiroshi Toyao, Tokyo (JP); Yasuhiko Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/046,519

(22) PCT Filed: Apr. 3, 2019

(86) PCT No.: PCT/JP2019/014785
§ 371 (c)(1),
(2) Date: Oct. 9, 2020

(87) PCT Pub. No.: WO2019/198588
PCT Pub. Date: Oct. 17, 2019

(65) Prior Publication Data

US 2021/0167505 A1 Jun. 3, 2021

(30) Foreign Application Priority Data

Apr. 12, 2018 (JP) ..... JP2018-077203

(51) Int. Cl.
*H01P 7/08* (2006.01)
*H01Q 9/04* (2006.01)
*H01Q 1/48* (2006.01)

(52) U.S. Cl.
CPC ..... *H01Q 9/0407* (2013.01); *H01Q 1/48* (2013.01)

(58) Field of Classification Search
CPC .. H01Q 1/38–50; H01Q 9/0407; H01Q 19/10; H01P 7/08; H01P 1/203
See application file for complete search history.

(56) References Cited

U.S. PATENT DOCUMENTS 5,055,809 A * 10/1991 Sagawa ..... H01P 1/20336 333/204
5,164,690 A * 11/1992 Yeh ..... H01P 1/20381 333/204
10,476,132 B2 11/2019 Kosaka et al.
2003/0148784 A1 8/2003 Sawamura et al.
2014/0203993 A1 7/2014 Toyao
2017/0040689 A1 2/2017 Toyao
(Continued)

FOREIGN PATENT DOCUMENTS

JP 2015179938 A 10/2015
WO 2013027824 A1 2/2013
(Continued)

OTHER PUBLICATIONS

Extended European Search Report (EESR) dated Apr. 16, 2021 issued in counterpart European Application No. 19785015.9.
(Continued)

*Primary Examiner* — Hasan Islam
(74) *Attorney, Agent, or Firm* — Holtz, Holtz & Volek PC

(57) ABSTRACT

A split-ring resonator comprises a first ground terminal which is separated from a ground pattern.

6 Claims, 33 Drawing Sheets

(56) References Cited

U.S. PATENT DOCUMENTS

| | | | | |
|---|---|---|---|---|
| 2017/0117612 | A1 | 4/2017 | Toyao et al. | |
| 2018/0090833 | A1 | 3/2018 | Kosaka | |
| 2018/0234072 | A1* | 8/2018 | Kuo | H01Q 1/48 |

FOREIGN PATENT DOCUMENTS

| | | | |
|---|---|---|---|
| WO | 2015151139 | A1 | 10/2015 |
| WO | 2015151430 | A1 | 10/2015 |
| WO | 2016159369 | A1 | 10/2016 |

OTHER PUBLICATIONS

European Office Action dated Dec. 17, 2021, issued in counterpart European Application No. 19785015.9.

International Search Report (ISR) (and English translation thereof) dated Jun. 25, 2019 issued in International Application No. PCT/JP2019/014785.

Written Opinion dated Jun. 25, 2019 issued in International Application No. PCT/JP2019/014785.

Korean Office Action (and English language translation thereof) dated Sep. 13, 2021 issued in counterpart Korean Application No. 10-2020-7029052.

European Office Action dated Jul. 18, 2022, issued in counterpart European Application No. 19785015.9.

Taiwanese Office Action (and English language translation thereof) dated Jun. 30, 2022, issued in counterpart Taiwanese Application No. 108112227.

Japanese Office Action (and English language translation thereof) dated Oct. 5, 2022, issued in counterpart Japanese Application No. 2020-513218.

* cited by examiner

SPLIT-RING RESONATOR, BOARD AND CONNECTOR

TECHNICAL FIELD

This invention relates to a split-ring resonator, a board and a connector.

BACKGROUND ART

An antenna with a split-ring resonator is known as a compact antenna used in a wireless communication device. For example, Patent Document 1 discloses a wireless communication device comprising a split-ring resonator.

PRIOR ART DOCUMENTS

Patent Document(s)

Patent Document 1: WO 2013/027824

SUMMARY OF INVENTION

Technical Problem

The split-ring resonator of Patent Document 1 is formed directly on a board while being connected to a ground pattern. Therefore, the split-ring resonator according to the aspect disclosed in Patent Document 1 neither can be distributed as a single component nor can be flexibly combined with the other component in accordance with design requirements. Thus, according to the aspect disclosed in Patent Document 1, the split-ring resonator cannot be used as a component.

The object of an aspect of the present disclosure is to provide a split-ring resonator, a board and a connector for solving one or more of the problems described above.

Solution to Problem

A split-ring resonator according to an aspect of the present disclosure comprises a first ground terminal which is separated from a ground pattern.

A board according to an aspect of the present disclosure comprises a terminal configured to be connected to a ground terminal, which is separated from a ground pattern, of a split-ring resonator according to an aspect of the present disclosure.

A connector according to an aspect of the present disclosure comprises a terminal configured to be connected to a ground terminal, which is separated from a ground pattern, of a split-ring resonator according to an aspect of the present disclosure.

Advantageous Effects of Invention

Various aspects of the present disclosure enable a split-ring resonator to be used as a component.

DESCRIPTION OF EMBODIMENTS

Various aspects according to the present disclosure are merely examples and are not intended to limit technical features of the invention described in Claims.

A split-ring resonator 11 according to an aspect of the present disclosure comprises a ground terminal 14 which is separated from a ground pattern.

Figure 1:
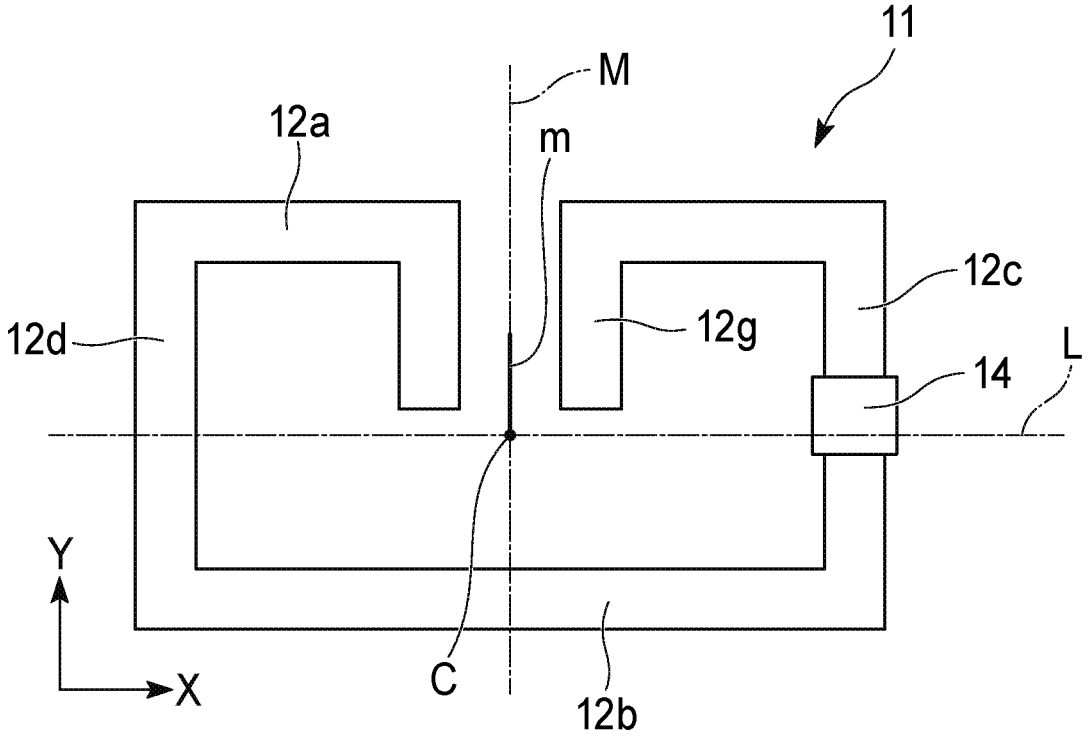
FIG. 1 is a plan view showing a split-ring resonator according to an aspect of the present disclosure.
Figure 2:
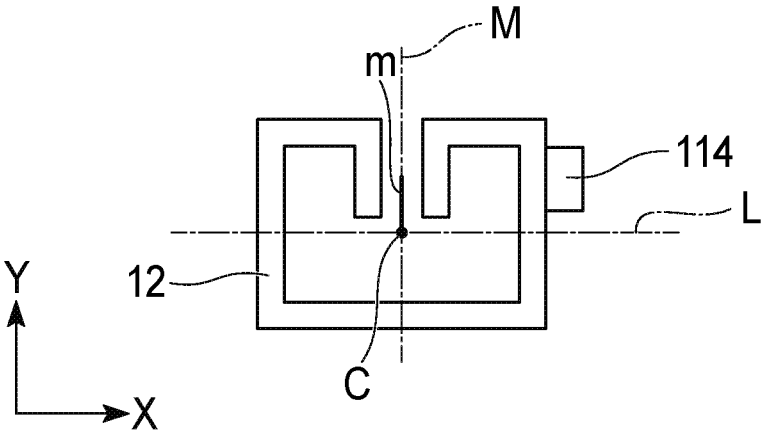
FIG. 2 is a plan view showing a split-ring resonator according to an aspect of the present disclosure.
Figure 3:
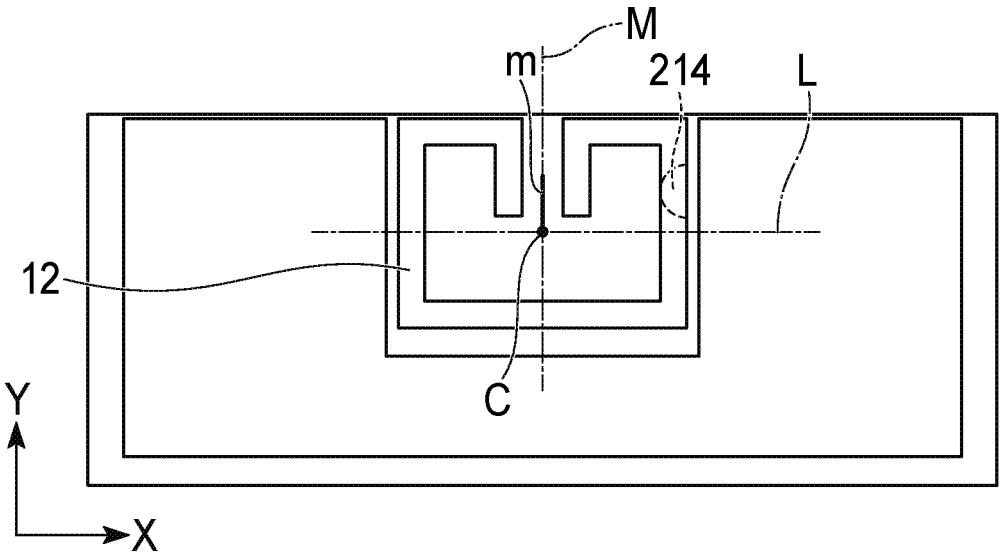
FIG. 3 is a plan view showing a split-ring resonator according to an aspect of the present disclosure.

FIGS. 1, 2 and 3 are figures showing examples of the split-ring resonator 11 according to an aspect of the present disclosure.

For example, a center of a ring of the split-ring resonator 11 will be referred to as a point C. For example, a line segment which connects a split of the split-ring resonator 11 and the point C to each other will be referred to as a line segment m. For example, a straight-line which includes the line segment m will be referred to as a straight-line M. For example, another straight-line which is perpendicular to the line segment m (or the straight-line M) and passes through the point C will be referred to as a straight-line L. Thus, on the straight-line L, the point C exists. For example, a direction in which the straight-line M extends will be referred to as the Y-axis direction. For example, a direction in which the straight-line L extends will be referred to as the X-axis direction.

For example, the split-ring resonator 11 may comprise a split-ring 12. For example, the split-ring 12 may be shaped into a C-like shape extending along a rectangular ring, the C-like shape being formed of: a split portion 12*g*; a first conductor 12*a* which extends in the X-axis direction while sandwiching the split portion 12*g* therebetween; a second conductor 12*b* which extends in the X-axis direction; a third conductor 12*c* which extends in the Y-axis direction; and a fourth conductor 12*d* which extends in the Y-axis direction. For example, the split-ring 12 may have a shape which extends along one of various rings including a circular ring, an elliptical ring, a track-shaped ring and any other rings. For example, the split-ring 12 may be formed of a metal plate.

For example, the split-ring resonator 11 may comprise the ground terminal 14 separated from a ground pattern. For example, the split-ring resonator 11 may comprise not only the ground terminal 14 but also a plurality of the ground terminals 14 each separated from a ground pattern. For example, the ground terminal 14 may have any structure, provided that the structure is electrically connectable with a ground pattern. For example, the ground terminal 14 may be configured to be electrically connected with a ground pattern via soldering, pressure joining, a connector, a pin, etc. For example, the ground terminal 14 may be a land pattern as shown in FIG. 1. For example, the ground terminal 14 may be a pattern which projects outward from the outer circumference of the split-ring resonator 11 as shown in FIG. 2. For example, the ground terminal 14 may be an exposed pattern which is formed by partially removing a coat of the split-ring resonator 11 as shown in FIG. 3. For example, not limited to the ground terminal 14 but any one of the ground terminals of the present disclosure may have any structure, provided that the structure is electrically connectable with a ground pattern. For example, the ground terminal 14 may be formed of a metal plate.

Figure 4:
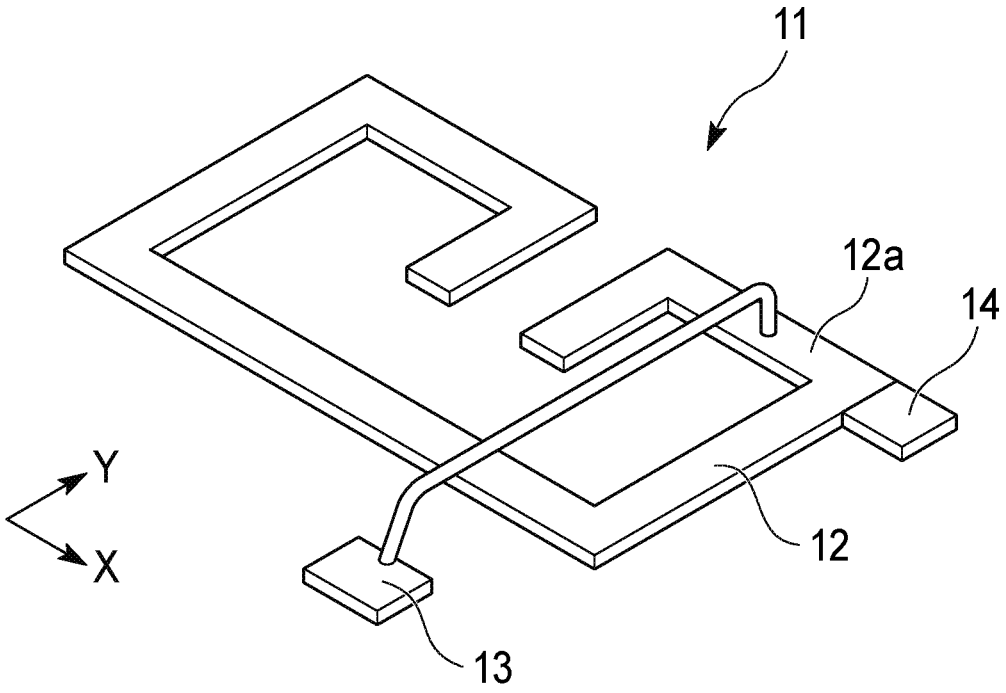
FIG. 4 is a perspective view showing a split-ring resonator according to an aspect of the present disclosure.
Figure 5:
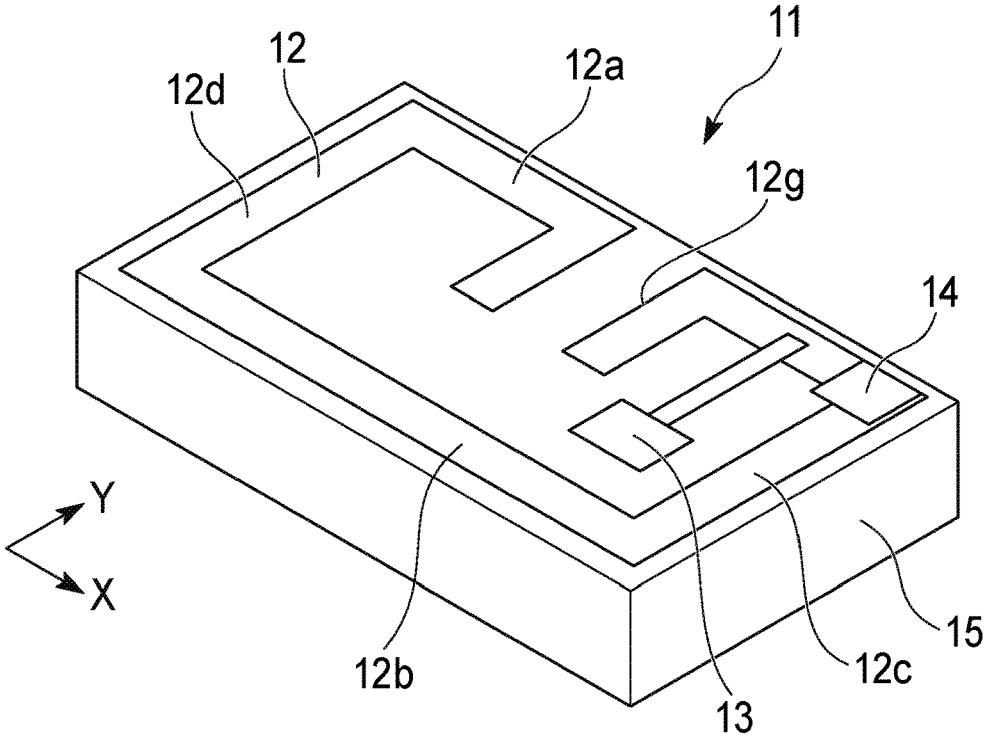
FIG. 5 is a perspective view showing a split-ring resonator according to an aspect of the present disclosure.
Figure 6:
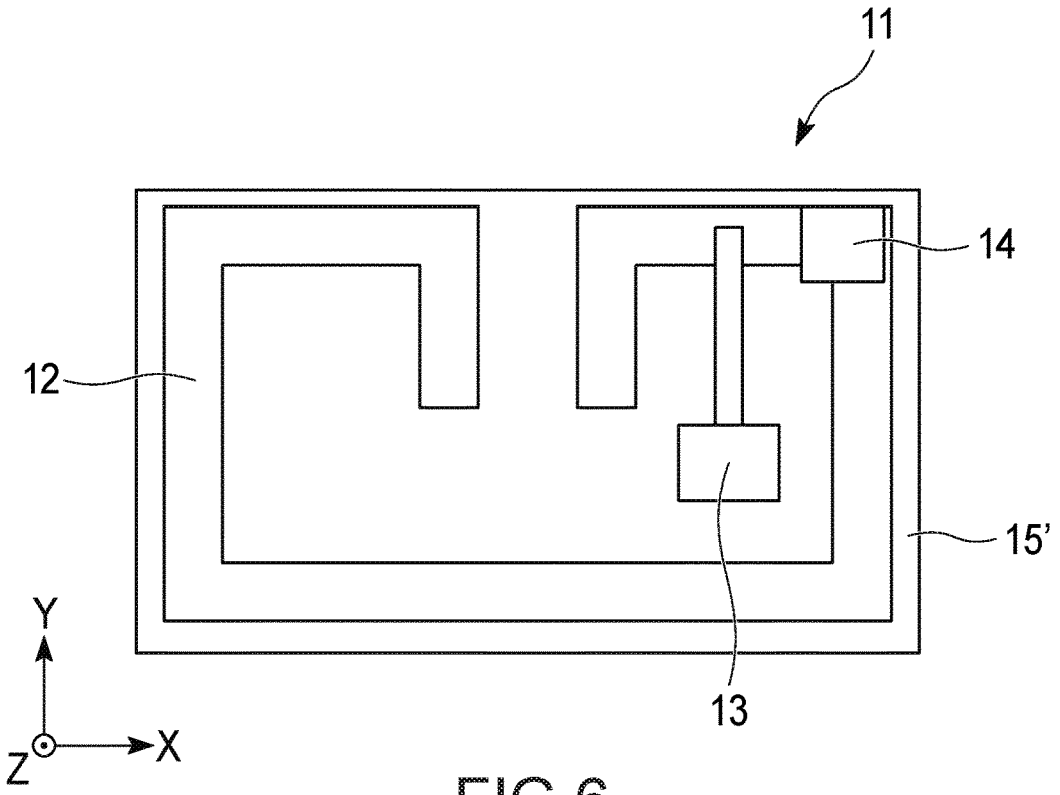
FIG. 6 is a plan view showing a split-ring resonator according to an aspect of the present disclosure.

FIGS. 4, 5 and 6 are figures showing examples of the split-ring resonator 11 according to an aspect of the present disclosure. FIGS. 4, 5 and 6 show a structure in which the split-ring resonator 11 comprises the one ground terminal 14. However, the split-ring resonator 11 may comprise two or more of the ground terminals.

For example, as shown in FIG. 4, the split-ring resonator 11 may comprise the split-ring 12, the ground terminal 14 and a feeding terminal 13. For example, the feeding terminal 13 may be formed of a wire and a metal plate. For example, the feeding terminal 13 may be a terminal for supplying radio frequency (RF) signals to the split-ring 12. For example, the feeding terminal 13 may be connected to the split-ring 12. For example, the feeding terminal 13 may be connected to a transmission line. For example, the feeding terminal 13 may be connected to the first conductor 12*a*.

For example, as shown in FIG. 5, the split-ring resonator 11 may comprise the split-ring 12, the ground terminal 14, the feeding terminal 13 and a chip body 15.

For example, as shown in FIG. 6, the split-ring resonator 11 may comprise the split-ring 12, the ground terminal 14, the feeding terminal 13 and a printed circuit board 15'. For example, as shown in FIG. 6, the split-ring 12, the ground terminal 14 and the feeding terminal 13 are provided on one of surfaces of the printed circuit board 15'. For example, the printed circuit board 15' may have either a single-layer structure or a multi-layer structure. For example, when the printed circuit board 15' has a multi-layer structure, the split-ring 12, the ground terminal 14 and the feeding terminal 13 may be provided on one of layers thereof.

A board according to an aspect of the present disclosure comprises a terminal configured to be connected to a ground terminal, which is separated from a ground pattern, of a split-ring resonator according to an aspect of the present disclosure.

Figure 7:
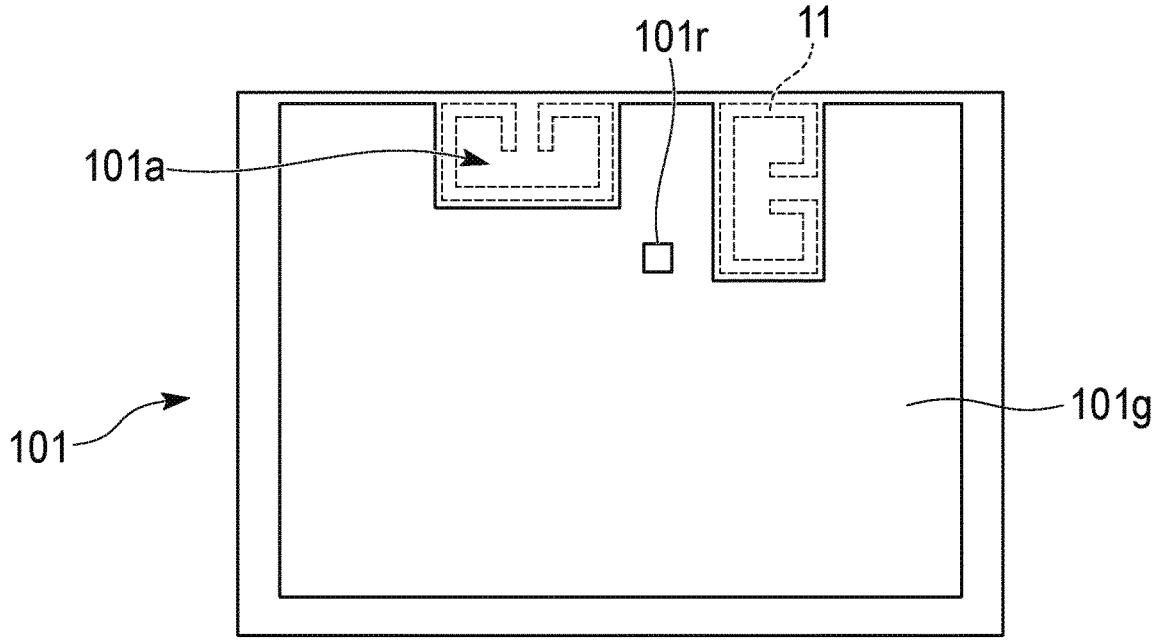
FIG. 7 is a plan view showing a board according to an aspect of the present disclosure.
Figure 8:
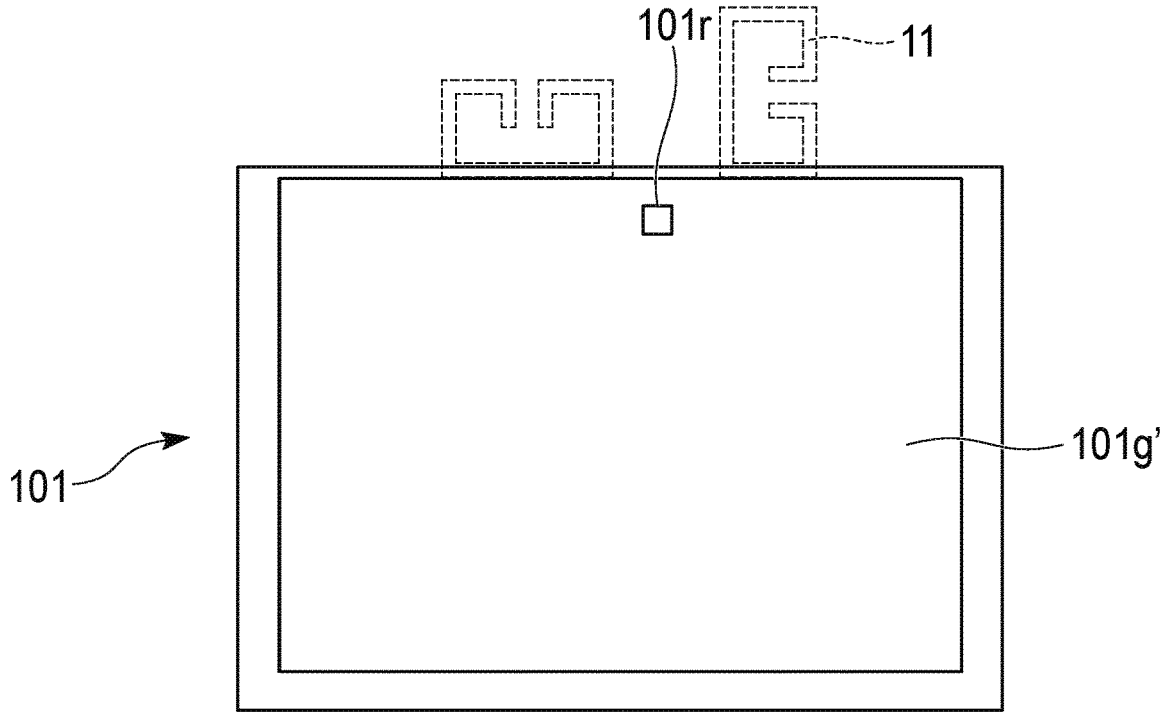
FIG. 8 is a plan view showing a board according to an aspect of the present disclosure.

FIGS. 7 and 8 are figures showing examples of a board 101 according to an aspect of the present disclosure.

For example, the board 101 may comprise a ground pattern 101*g* having a rectangular outline. For example, the board 101 may comprise a reception terminal 101*r*. For example, the reception terminal 101*r* may be a terminal configured to be connected to a ground terminal, which is separated from a ground pattern, of a split-ring resonator according to an aspect of the present disclosure. For example, as shown in FIG. 7, the board 101 may comprise an opening 101*a* which corresponds to a shape and a size of a split-ring resonator according to an aspect of the present disclosure. In this case, for example, as shown in FIG. 7, an antenna may be formed by accommodating a split-ring resonator according to an aspect of the present disclosure in the opening 101*a* and by connecting the reception terminal 101*r* to a ground terminal, which is separated from a ground pattern, of the split-ring resonator according to an aspect of the present disclosure. For example, as shown in FIG. 8, the board 101 may comprise no opening which corresponds to a shape and a size of a split-ring resonator according to an aspect of the present disclosure. In this case, for example, as shown in FIG. 8, an antenna may be formed by arranging a split-ring resonator according to an aspect of the present disclosure to be adjacent to a side or an edge of a ground pattern 101*g*' and by connecting the reception terminal 101*r* to a ground terminal, which is separated from a ground pattern, of the split-ring resonator according to an aspect of the present disclosure.

A connector according to an aspect of the present disclosure comprises a terminal configured to be connected to a ground terminal, which is separated from a ground pattern, of a split-ring resonator according to an aspect of the present disclosure.

Figure 9:
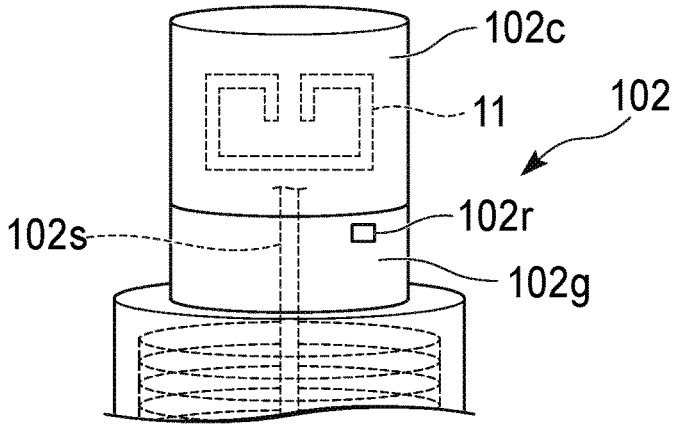
FIG. 9 is a perspective view showing a connector according to an aspect of the present disclosure.
Figure 10:
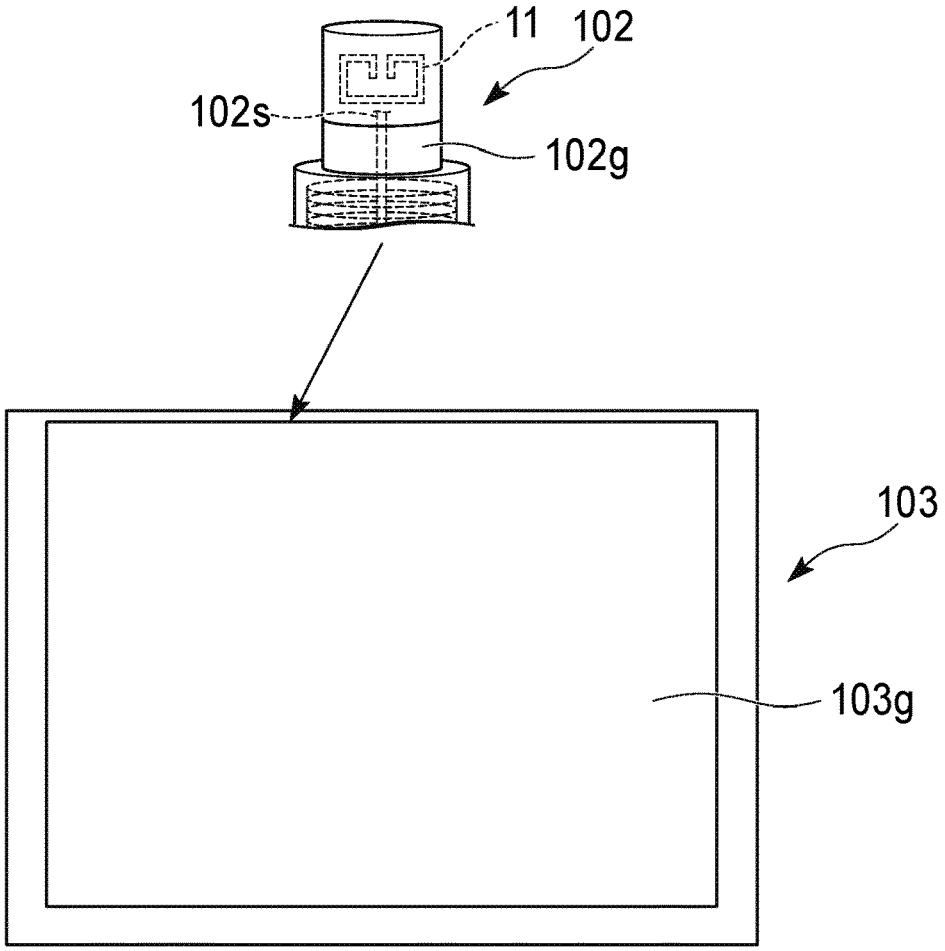
FIG. 10 is a view for explaining about a connection between a connector and a main circuit board according to an aspect of the present disclosure.

FIGS. 9 and 10 are figures showing examples of a connector 102 according to an aspect of the present disclosure.

For example, the connector 102 may comprise a ground pattern 102*g*. For example, the connector 102 may comprise a reception terminal 102*r*. For example, the connector 102 may comprise a feeding pattern 102*s*. For example, the connector 102 may be shaped in a cylindrical shape whose axial direction is an extending direction of the feeding pattern 102*s*, and whose circumference surface is formed of the ground pattern 102*g*, so that the connector 102 may be formed as a coaxial connector having a central wire of the connector formed of the feeding pattern 102*s* and having an outer conductor of the connector formed of the ground pattern 102*g*.

For example, the ground pattern 102*g* may have a screw shape which is located at one of opposite ends of the connector 102 in the axial direction and may be electrically and mechanically connectable with another ground pattern having a corresponding screw shape. For example, the connector 102 may comprise a dielectric cap 102*c* which is located at a remaining one of the opposite ends in the axial direction and is adjacent to the ground pattern 102*g*, so that the split-ring resonator 11 may be accommodatable in the dielectric cap 102*c*. For example, the split-ring resonator 11 may be provided at the remaining one of the opposite ends of the connector 102 in the axial direction to be adjacent to the ground pattern 102*g*. For example, the ground pattern 102*g* may be connected to the ground terminal 14 via the reception terminal 102*r*, and the feeding pattern 102*s* may be connected to the feeding terminal 13.

For example, the connector 102 may be a female connector with the ground pattern 102*g* having a female screw shape. For example, the connector 102 may be connected to a main circuit board 103 having a male connector. For example, as shown in FIG. 9, the split-ring resonator 11 (ground terminal 14) may be connected to a main ground pattern 103*g* of the main circuit board 103 via the ground pattern 102*g*. For example, the ground pattern 102*g* may have either a female screw shape or a male screw shape. For example, as shown in FIG. 10, the ground pattern 102*g* of the connector 102 may have a male screw shape, and the connector 102 may be connected to a main circuit board having a female connector.

When the ground terminal 14 is connected with a ground pattern, a current in accordance with RF signals can flow between the feeding terminal 13 and the ground terminal 14 of a split-ring resonator 21. Therefore, an antenna can be formed by combining the aforementioned split-ring resonator according to an aspect of the present disclosure to the aforementioned board according to an aspect of the present disclosure or the aforementioned connector according to an aspect of the present disclosure. Therefore, according to an aspect of the present disclosure described above, a split-ring resonator can be distributed as a single component and can be flexibly combined with the other component in accordance with design requirements.

The split-ring resonator 21 according to an aspect of the present disclosure is based on the split-ring resonator 11 while a first ground terminal is located on a section where a split of the split-ring resonator exists as viewed from the straight-line L. On the straight-line L, the point C exists, the point C being a center of a ring of the split-ring resonator. The straight-line L is perpendicular to the line segment m which connects the point C and the split to each other.

FIGS. 11, 12, 13 and 14 are figures showing examples of the split-ring resonator 21 according to an aspect of the present disclosure.

For example, each section of a split-ring resonator will be defined as follows.

(An Upper Section of a Split-Ring Resonator)

Figure 11:
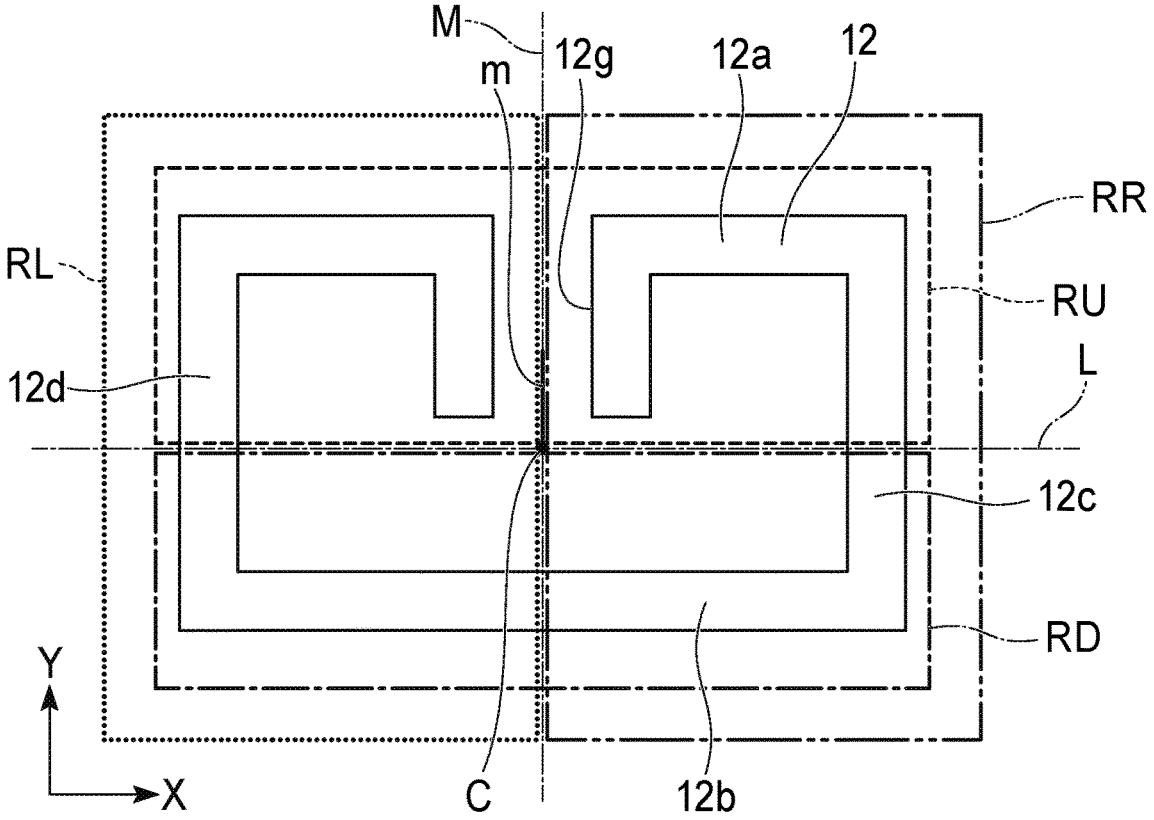
FIG. 11 is a view for explaining about a split-ring resonator according to an aspect of the present disclosure.

As shown in FIG. 11, a section where a split of a split-ring resonator is as viewed from the straight-line L is defined as an upper section RU of the split-ring resonator. For example, an upper half part of the split-ring 12 (i.e. a part formed of: the split portion 12*g*; the first conductor 12*a*; a part of the third conductor 12*c* which is nearer to the first conductor 12*a* than to the second conductor 12*b*; and a part of the fourth conductor 12*d* which is nearer to the first conductor 12*a* than to the second conductor 12*b*) may be configured to be the upper section RU of the split-ring resonator.

(A Lower Section of a Split-Ring Resonator)

As shown in FIG. 11, a section opposite to the section for the split of the split-ring resonator across the straight-line L is defined as a lower section RD of the split-ring resonator. For example, a lower half part of the split-ring 12 (i.e. a part formed of: the second conductor 12*b*; a part of the third conductor 12*c* which is nearer to the second conductor 12*b* than to the first conductor 12*a*; and a part of the fourth conductor 12*d* which is nearer to the second conductor 12*b* than to the first conductor 12*a*) may be configured to be the lower section RD of the split-ring resonator.

(A Right Section RR of a Split-Ring Resonator)

As shown in FIG. 11, one of opposite sections of the split-ring resonator across the straight-line M (the right section in FIG. 9) is defined as a right section RR. For example, a right half part of the split-ring 12 (i.e. a part formed of: the third conductor 12*c*; a part of the first conductor 12*a* which is nearer to the third conductor 12*c* than to the fourth conductor 12*d*; a part of the split portion 12*g* which is nearer to the third conductor 12*c* than to the fourth conductor 12*d*; and a part of the second conductor 12*b* which is nearer to the third conductor 12*c* than to the fourth conductor 12*d*) may be configured to be the right section RR of the split-ring resonator.

(A Left Section of a Split-Ring Resonator)

As shown in FIG. 11, a remaining one of the opposite sections across the straight-line M (the left section in FIG. 9) is defined as a left section RL. For example, a left half part of the split-ring 12 (i.e. a part formed of: the fourth conductor 12*d*; a part of the first conductor 12*a* which is nearer to the fourth conductor 12*d* than to the third conductor 12*c*; a part of the split portion 12*g* which is nearer to the fourth conductor 12*d* than to the third conductor 12*c*; and a part of the second conductor 12*b* which is nearer to the fourth conductor 12*d* than to the third conductor 12*c*) may be configured to be the left section RL of the split-ring resonator.

For example, the split-ring resonator 21 may comprise the ground terminal 14 located on the upper section RU of the split-ring resonator 21. For example, a position of each conductor of the third conductor 12*c* and the fourth conductor 12*d* may be provided with one of the ground terminals 14, respectively. For example, each ground terminal 14 may be connected to each conductor of the third conductor 12*c* and the fourth conductor 12*d*, respectively.

For example, the split-ring resonator 21 may be provided at a position of the opening 101*a* of the board 101. For example, the split-ring resonator 21 may be provided in the opening 101*a* so that a separation direction of the split portion 12*g* is directed to a direction along which the opening 101*a* is widen. For example, the split-ring resonator 21 may be provided to the board 101 so that the split-ring resonator 21 is accommodated within the opening 101*a*. Here, the direction along which the opening 101*a* is widen is defined as a direction along which one of the sides of the rectangular shape of the ground pattern 101*g* extends, the one of the sides having a rectangular-shaped cut.

For example, each ground terminal 14 may be electrically connected with the ground pattern 101*g* via soldering, pressure joining, etc. For example, each ground terminal 14 may be connected to the ground pattern 101*g* via solder SR. For example, the first conductor 12*a* may be connected to a feeding wire WS which supplies RF signals.

For example, a position of each conductor of the third conductor 12*c* and the fourth conductor 12*d* may be provided at any position in the upper section RU of the split-ring resonator 21. For example, the ground terminal 14 may be provided at a position of the first conductor 12*a*. In this case, the ground terminal 14 may be connected to the first conductor 12*a*. For example, it may be connected to the third conductor 12*c* or the fourth conductor 12*d* at a position which is nearer to the split portion 12*g* than to the ground terminal 14. For example, the feeding wire WS may be connected to the split portion 12*g*.

A board according to an aspect of the present disclosure comprises a terminal configured to be connected to the ground terminal, which is separated from a ground pattern, of the split-ring resonator 21 according to an aspect of the present disclosure.

Figure 12:
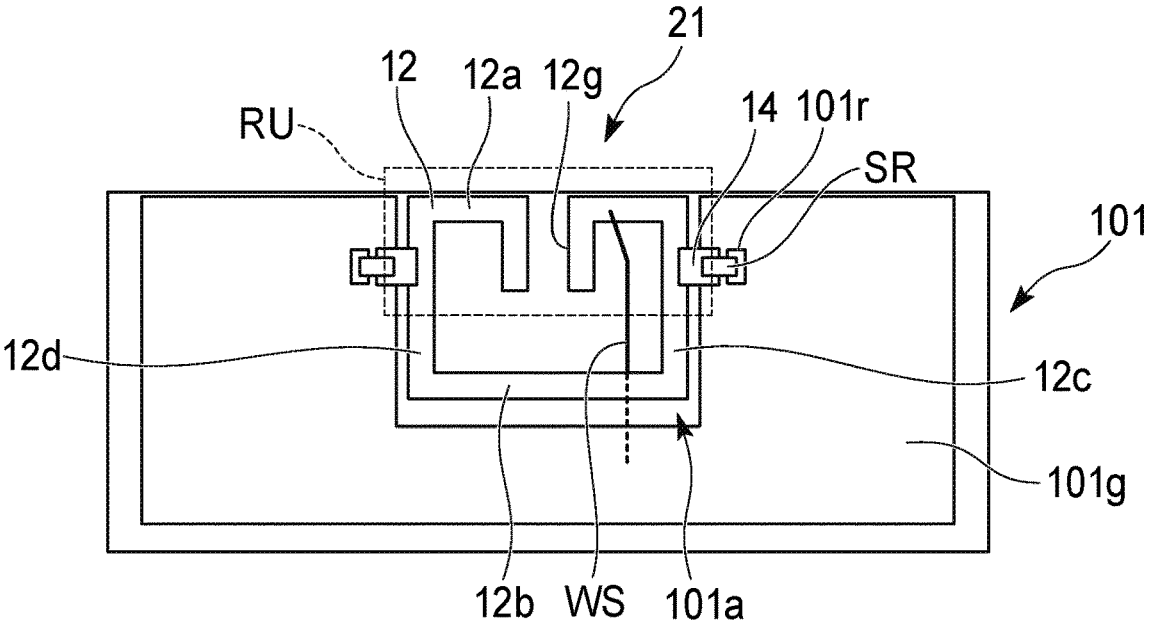
FIG. 12 is a plan view showing a split-ring resonator according to an aspect of the present disclosure.
Figure 13:
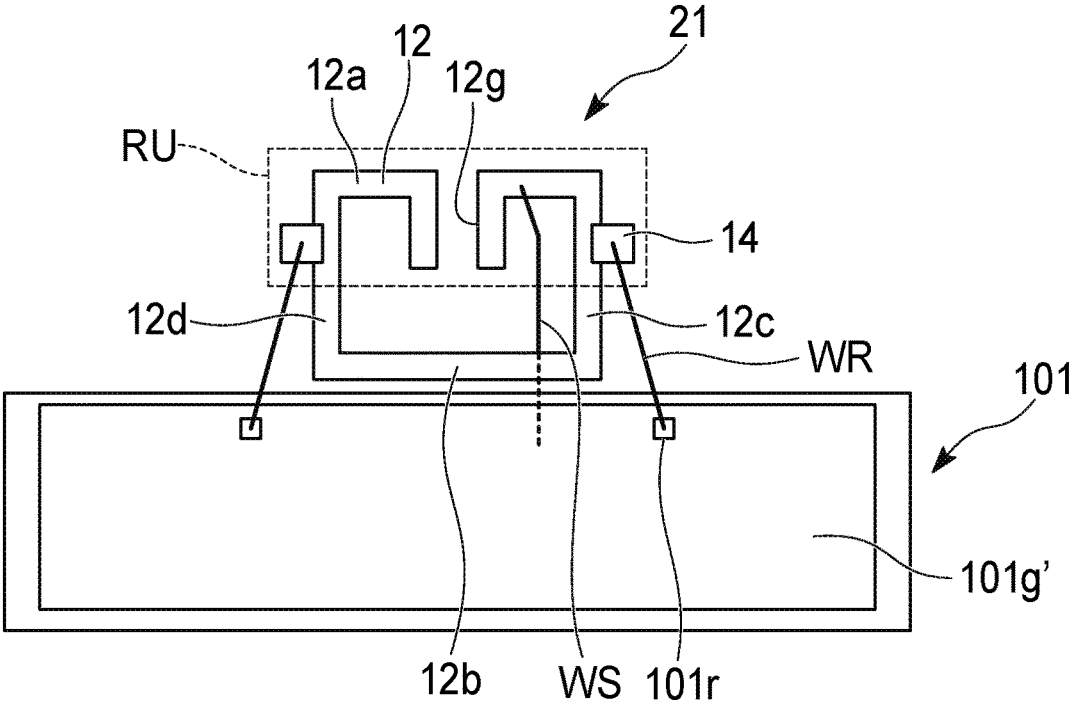
FIG. 13 is a plan view showing a split-ring resonator according to an aspect of the present disclosure.

FIGS. 12 and 13 are figures showing examples of the board 101 according to an aspect of the present disclosure.

For example, the split-ring resonator 21 may comprise the ground terminal 14 located on the upper section RU of the split-ring resonator 21. For example, a position of each conductor of the third conductor 12*c* and the fourth conductor 12*d* is provided with one of the ground terminals 14, respectively. Each ground terminal 14 may be connected to each conductor of the third conductor 12*c* and the fourth conductor 12*d*, respectively.

For example, the split-ring resonator 21 may be provided adjacent to an edge of the board 101. For example, the split-ring resonator 21 may be provided so that the separation direction of the split portion 12*g* is aligned with a direction along which the adjacent edge of the board 101 extends. For example, each ground terminal 14 may be electrically connected with the ground pattern 101*g*' via a wire WR by soldering, pressure joining, etc. For example, the feeding wire WS and the wire WR may be realized by a central wire and an outer conductor of a connector.

For example, the ground terminal 14 may be provided at any position in the upper section RU of the split-ring resonator 21. For example, the ground terminal 14 may be provided at a position of the first conductor 12*a*. In this case, the ground terminal 14 may be connected to the first conductor 12*a*.

A connector according to an aspect of the present disclosure comprises a terminal configured to be connected to the ground terminal, which is separated from a ground pattern, of the split-ring resonator 21 according to an aspect of the present disclosure.

Figure 14:
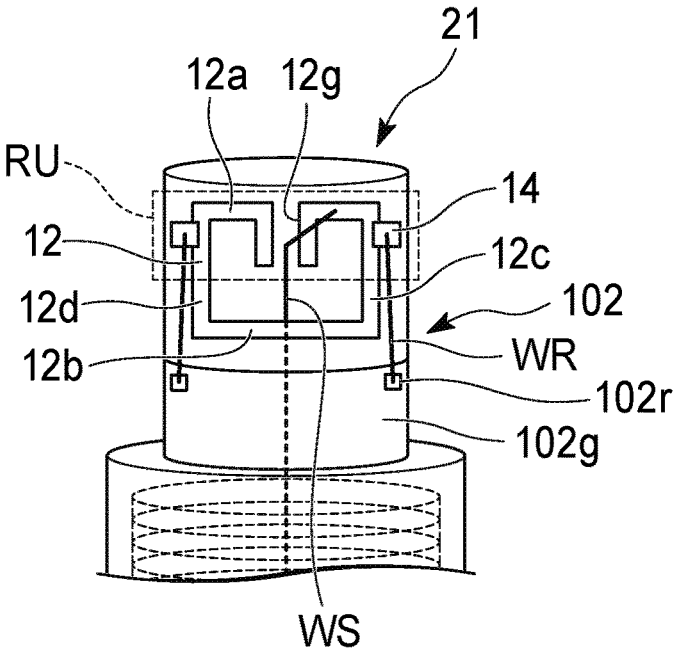
FIG. 14 is a perspective view showing a split-ring resonator according to an aspect of the present disclosure.

FIG. 14 is a figure showing an example of the connector 102 according to an aspect of the present disclosure.

For example, the split-ring resonator 21 comprises the ground terminal 14 located on the upper section RU of the split-ring resonator 21. According to the present embodiment, a position of each conductor of the third conductor 12*c* and the fourth conductor 12*d* may be provided with one of the ground terminals 14, respectively. For example, each ground terminal 14 may be connected to each conductor of the third conductor 12*c* and the fourth conductor 12*d*, respectively.

For example, the split-ring resonator 21 may be provided to the connector 102. For example, the split-ring resonator 21 may be provided so that the separation direction of the split portion 12*g* is aligned with the radial direction of the connector 102. For example, each ground terminal 14 may be electrically connected with the ground pattern 102*g* via the wire WR by soldering, pressure joining, etc.

For example, it may be provided at any position in the upper section RU of the split-ring resonator 21. For example, the ground terminal 14 may be provided at a position of the first conductor 12*a*. In this case, the ground terminal 14 may be connected to the first conductor 12*a*.

Figure 15:
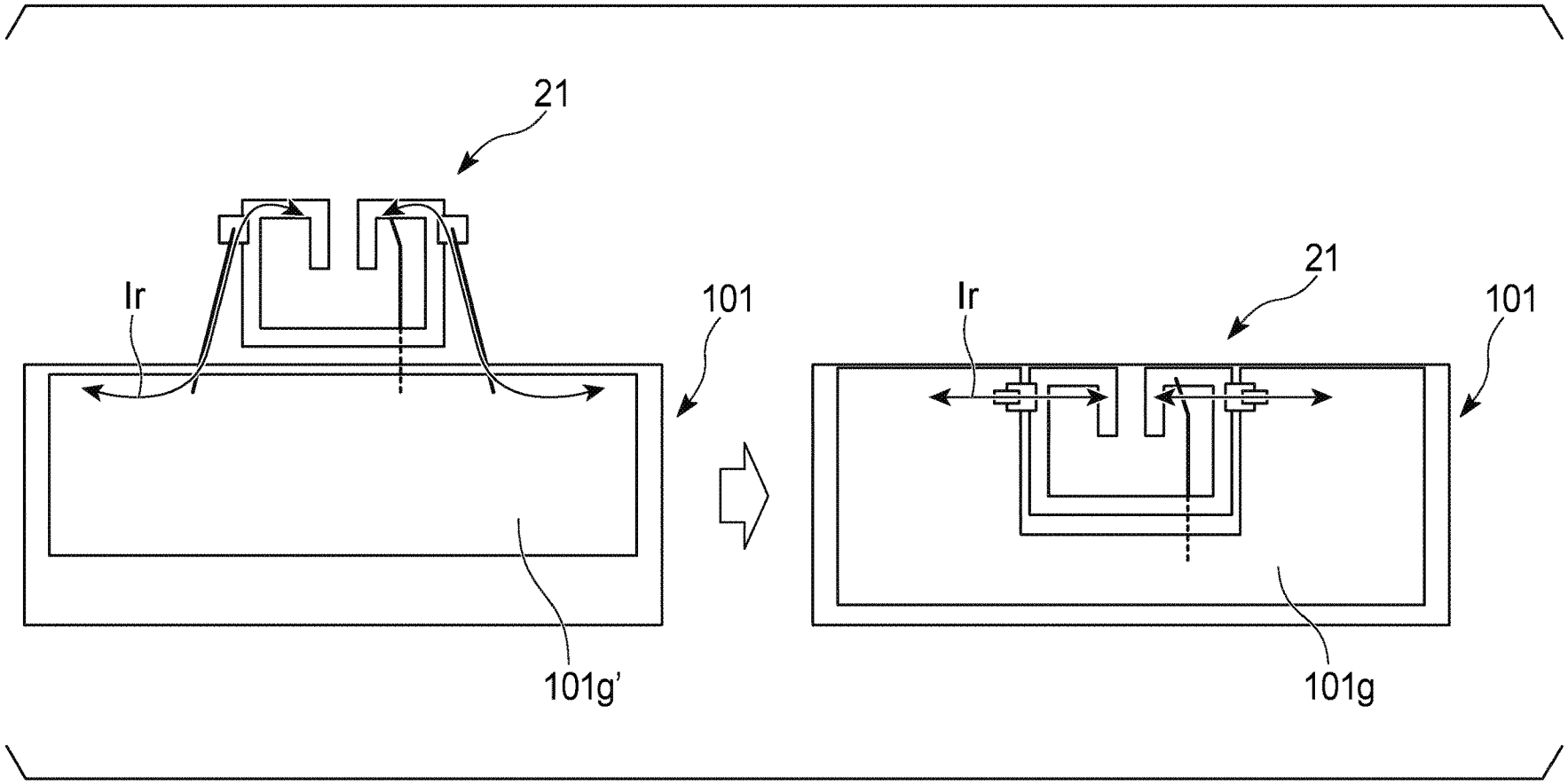
FIG. 15 is a view for comparing currents in split-ring resonators according to an aspect of the present disclosure.

As shown in FIG. 15, in a case where the split-ring resonator 21 is provided to an opening (in the case of the split-ring resonator 21 illustrated in FIG. 12), a current Ir which contributes for radiation easily flows in the upper section of the split-ring resonator 21 in comparison with another case where it is not provided to an opening (in the case of the split-ring resonator 21 illustrated in FIG. 13). Accordingly, in the split-ring resonator 21 illustrated in FIG. 12, because the ground terminal 14 is located on the upper section, the current Ir easily flows into another conductor through the ground terminal 14. As a result, the radiation property of the split-ring resonator 21 can be improved. Moreover, in the case where the split-ring resonator 21 is provided to an opening, the connection is made so that the split-ring resonator is accommodated within the opening. Accordingly, in the split-ring resonator 21 illustrated in FIG. 12, the current Ir in the upper section of the split-ring resonator 21 can flow on a side of the ground pattern 101*g* of the board 101 through the ground terminal 14 without changing its direction. Therefore, the radiation property of the split-ring resonator 21 can be further improved.

A split-ring resonator 31 according to an aspect of the present disclosure is based on the split-ring resonator 21 while comprising a second ground terminal which is separated from a ground pattern, and the first ground terminal is located at a first corner of the split-ring resonator 31. The second ground terminal is located on a section where the split exists as viewed from the straight-line L and is located at a second corner of the split-ring resonator.

Figure 16:
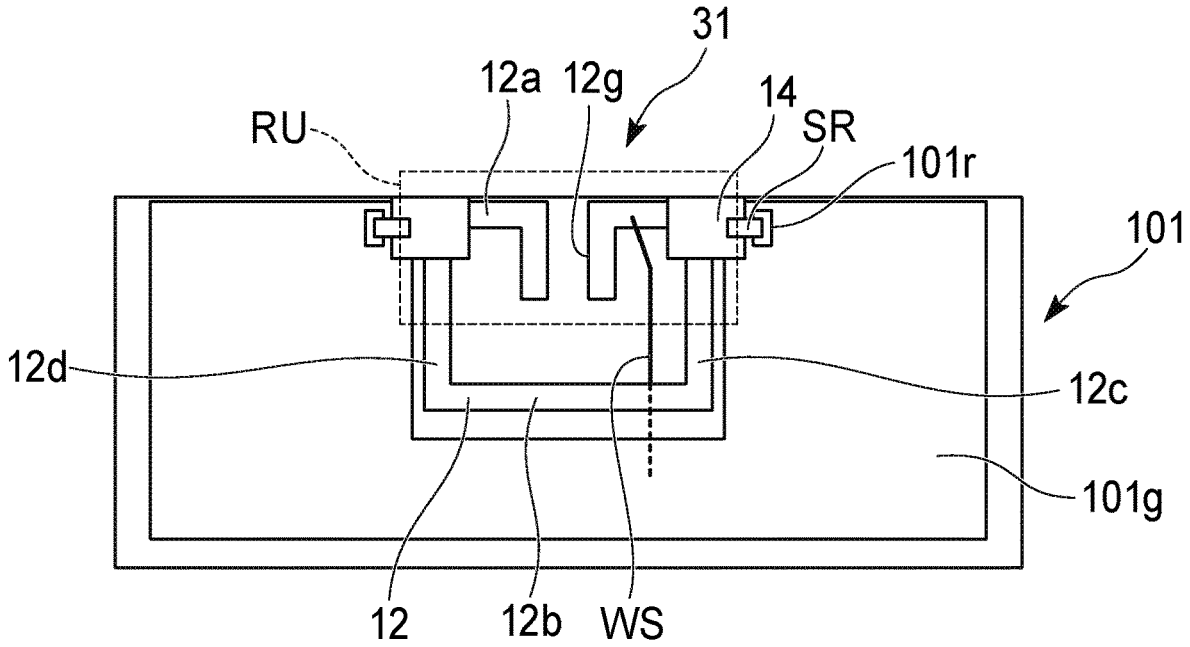
FIG. 16 is a plan view showing a split-ring resonator according to an aspect of the present disclosure.
Figure 17:
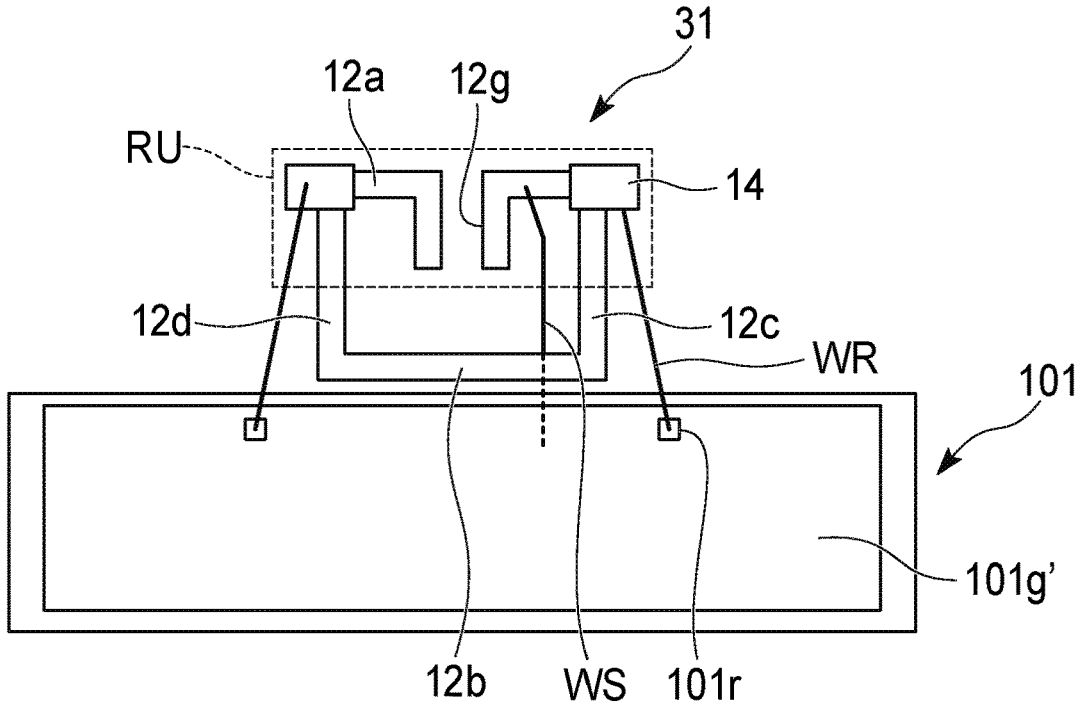
FIG. 17 is a plan view showing a split-ring resonator according to an aspect of the present disclosure.
Figure 18:
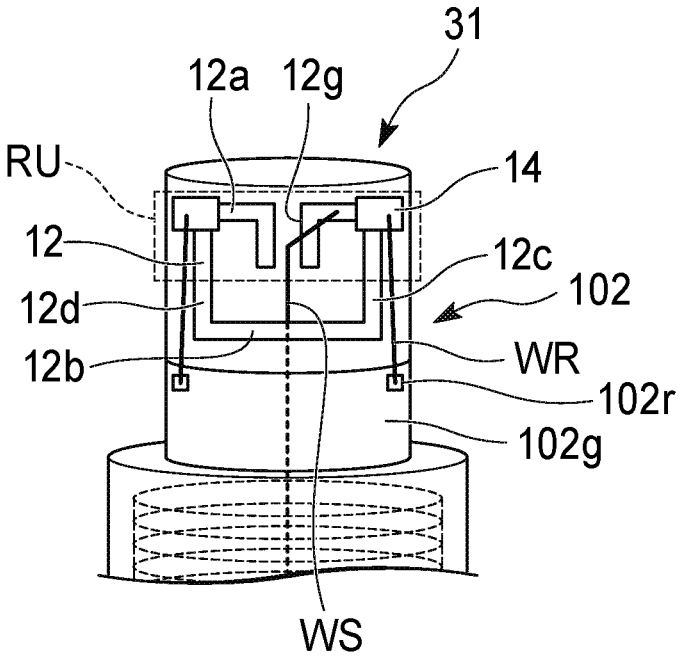
FIG. 18 is a perspective view showing a split-ring resonator according to an aspect of the present disclosure.

FIGS. 16, 17 and 18 are figures showing examples of the split-ring resonator 31 according to an aspect of the present disclosure.

For example, the split-ring resonator 31 may comprise the ground terminals 14 located at positions of two corners (two parts including the intersection of the first conductor 12*a* and the third conductor 12*c*, and the intersection of the first conductor 12*a* and the fourth conductor 12*d*) of the upper section RU of the split-ring resonator 31, respectively.

A board according to an aspect of the present disclosure comprises a terminal configured to be connected to the ground terminal, which is separated from a ground pattern, of the split-ring resonator 31 according to an aspect of the present disclosure.

FIGS. 16 and 17 are figures showing examples of the board 101 according to an aspect of the present disclosure.

For example, the split-ring resonator 31 may comprise the ground terminals 14 located at the positions of the two corners (each of the intersection of the first conductor 12*a* and the third conductor 12*c* and the intersection of the first conductor 12*a* and the fourth conductor 12*d*) of the upper section RU of the split-ring resonator 31, respectively.

A connector according to an aspect of the present disclosure comprises a terminal configured to be connected to the ground terminal, which is separated from a ground pattern, of the split-ring resonator 31 according to an aspect of the present disclosure.

FIG. 18 is a figure showing an example of the connector 102 according to an aspect of the present disclosure.

For example, the split-ring resonator 31 may comprise the ground terminals 14 located at the positions of the two corners (each of the intersection of the first conductor 12*a* and the third conductor 12*c* and the intersection of the first conductor 12*a* and the fourth conductor 12*d*) of the upper section RU of the split-ring resonator 31, respectively.

Moreover, in the split-ring resonator 31 illustrated in FIGS. 16, 17 and 18, because the ground terminals 14 are located on the two corners of the upper section RU of the split-ring resonator 31, the current Ir further easily flows along a side in comparison with the split-ring resonator 21 illustrated in FIGS. 12, 13 and 14. As a result, the radiation property of the split-ring resonator 31 can be further improved.

Figure 19:
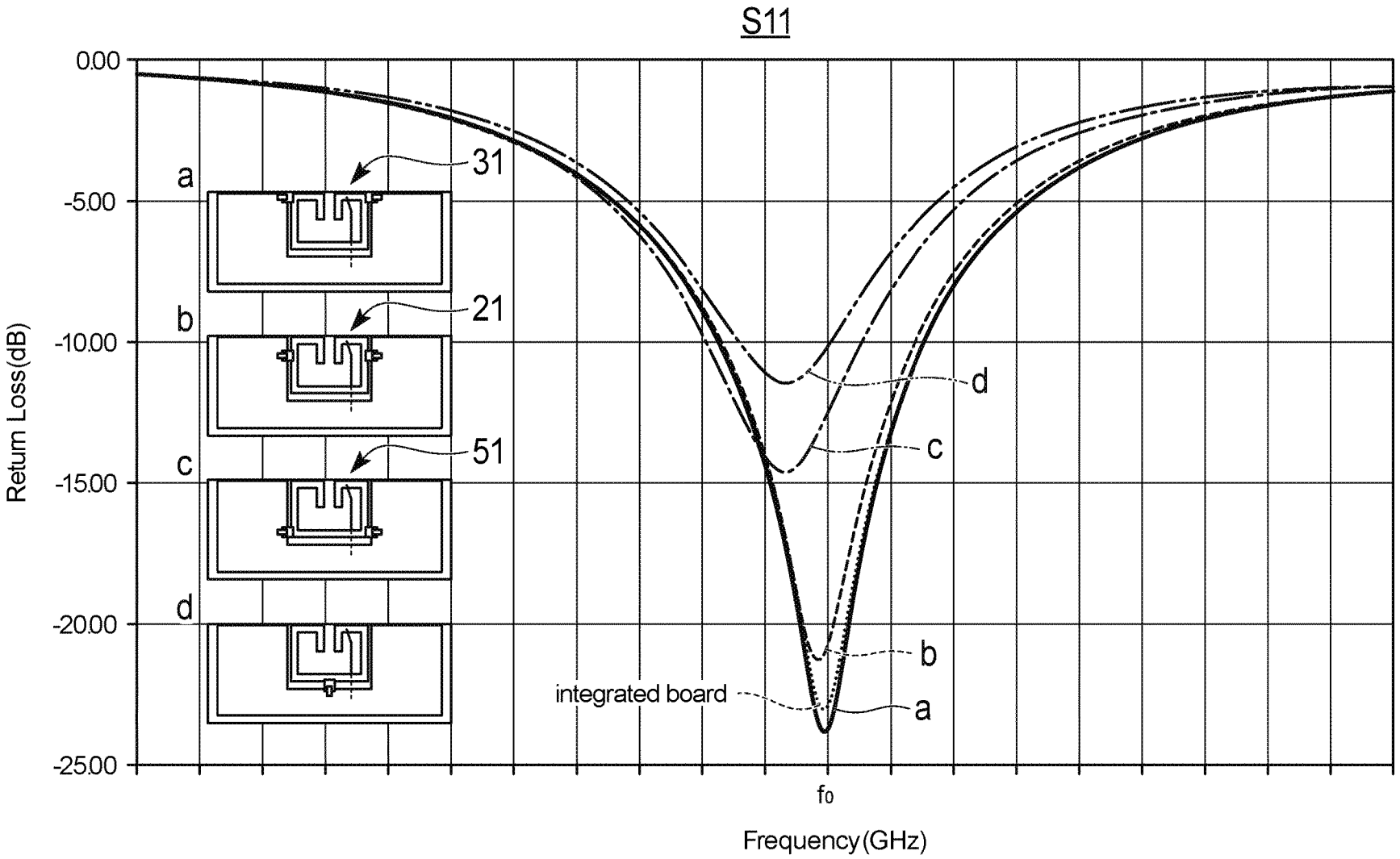
FIG. 19 is a graph showing return loss properties of split-ring resonators according to an aspect of the present disclosure.

FIG. 19 shows frequency characteristics of return loss of each split-ring resonator under the same condition. The curve a shows a return loss curve of the split-ring resonator 31 illustrated in FIG. 15. The curve b shows a return loss curve of the split-ring resonator 21 illustrated in FIG. 12. The curve c shows a return loss curve of a split-ring resonator 51 according to a seventh embodiment lately illustrated in FIG. 21. The curve d is a return loss curve of a reference example of a split-ring resonator which is based on a split-ring resonator 41 described later, and in which the ground terminal 14 is not provided while only a ground terminal 44 is provided. As shown in FIG. 19, return losses at resonance frequency f0 decrease in the order of the curve d, the curve c, the curve b and the curve a. In particular, the return loss property of the curve a is closest to the return loss property in a case where a split-ring resonator is integrally formed with a circuit board (in a case of an integral board).

The split-ring resonator 41 according to an aspect of the present disclosure is based on the split-ring resonator 21 or the split-ring resonator 31 while comprising a third ground terminal which is separated from a ground pattern, and the third ground terminal is located on a section where the split does not exist as viewed from the straight-line L.

Figure 20:
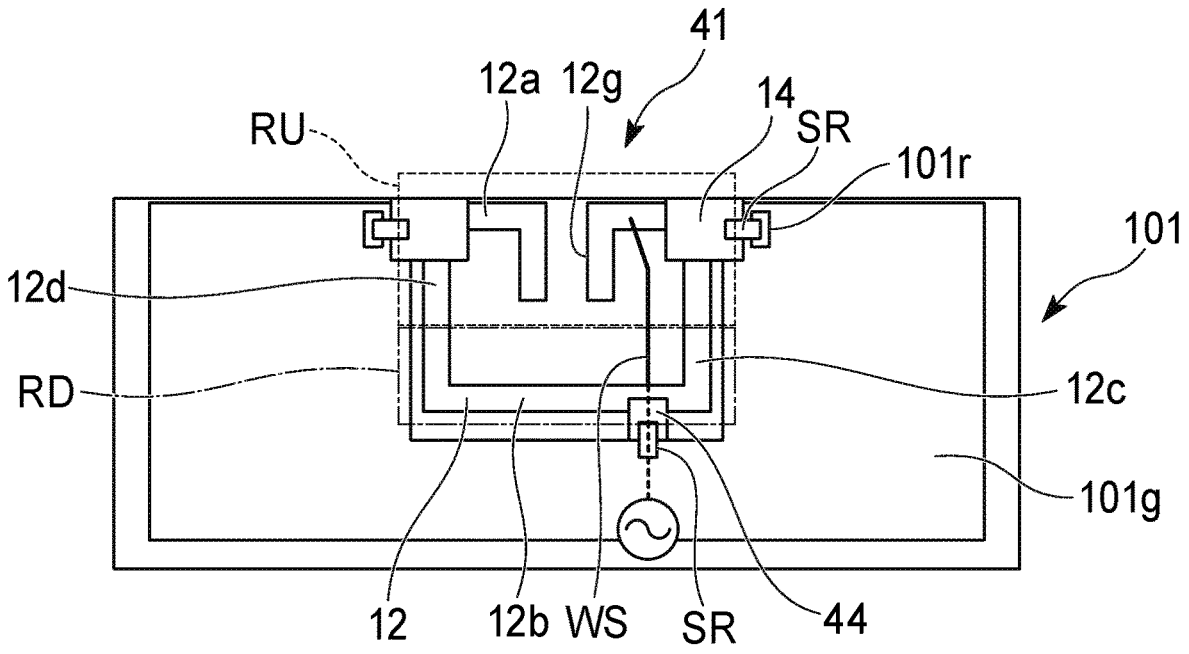
FIG. 20 is a plan view showing a split-ring resonator according to an aspect of the present disclosure.
Figure 21:
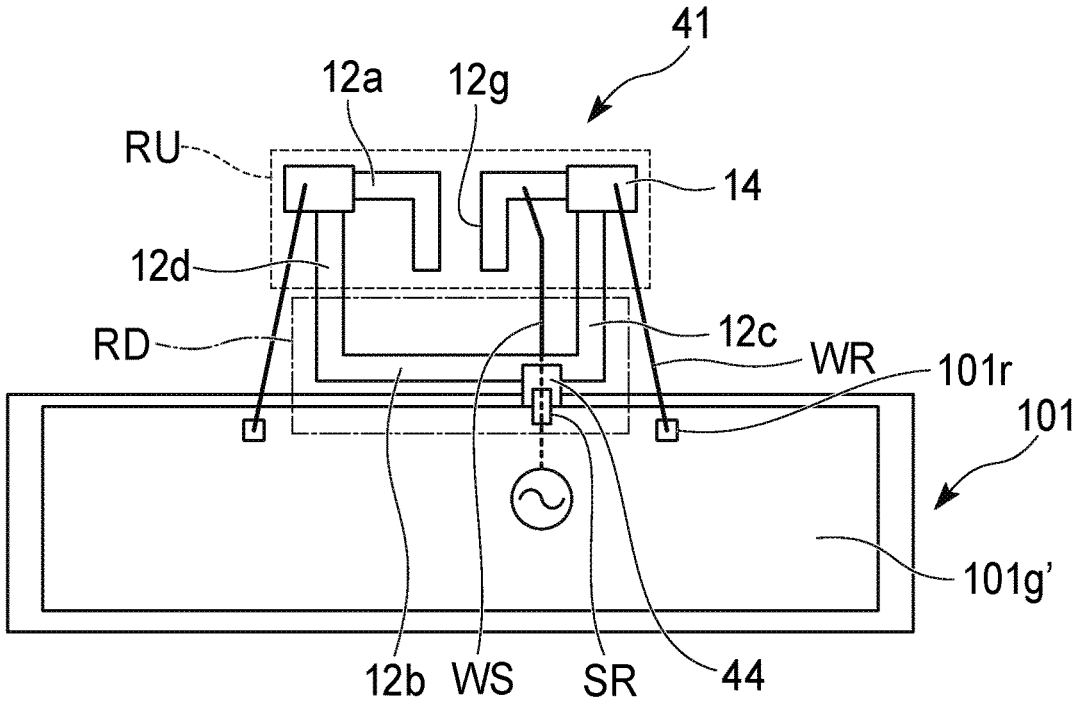
FIG. 21 is a plan view showing a split-ring resonator according to an aspect of the present disclosure.
Figure 22:
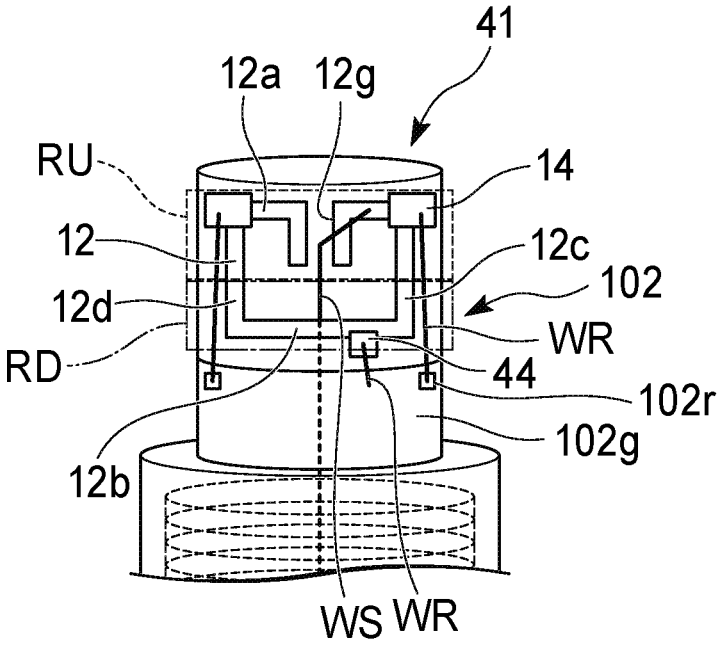
FIG. 22 is a perspective view showing a split-ring resonator according to an aspect of the present disclosure.

FIGS. 20, 21 and 22 are figures showing examples of the split-ring resonator 41 according to an aspect of the present disclosure.

For example, the split-ring resonator 41 comprises the ground terminals 14 located on the upper section RU of the split-ring resonator 41. For example, a position of each conductor of the third conductor 12*c* and the fourth conductor 12*d* may be provided with one of the ground terminals 14. For example, the split-ring resonator 41 may further comprise the ground terminal 44 located on the lower section RD of the split-ring resonator 41. For example, the ground terminal 44 may be provided at a position of the second conductor 12*b*. The ground terminal 44 may be connected to the second conductor 12*b*. For example, the ground terminal 44 may be connected to the ground pattern 101*g* via the solder SR.

A board according to an aspect of the present disclosure comprises a terminal configured to be connected to the ground terminal, which is separated from a ground pattern, of the split-ring resonator 41 according to an aspect of the present disclosure.

FIGS. 20 and 21 are figures showing examples of the board 101 according to an aspect of the present disclosure.

For example, the split-ring resonator 41 may further comprise the ground terminal 44 located on the lower section RD of the split-ring resonator 41. For example, the ground terminal 44 may be provided at a position of the second conductor 12*b*. For example, the ground terminal 44 may be connected to the second conductor 12*b*. For example, the ground terminal 44 may be connected to the ground pattern 101*g* via the solder SR.

A connector according to an aspect of the present disclosure comprises a terminal configured to be connected to the ground terminal, which is separated from a ground pattern, of the split-ring resonator 41 according to an aspect of the present disclosure.

FIG. 22 is a figure showing an example of the connector 102 according to an aspect of the present disclosure.

For example, the split-ring resonator 41 comprises the ground terminals 14 located on the upper section RU of the split-ring resonator 41. For example, a position of each conductor of the third conductor 12*c* and the fourth conductor 12*d* may be provided with one of the ground terminals 14. The split-ring resonator 41 further comprises the ground terminal 44 located on the lower section RD of the split-ring resonator 41. For example, the ground terminal 44 may be provided at a position of the second conductor 12*b*. For example, the ground terminal 44 may be connected to the second conductor 12*b*. For example, the ground terminal 44 may be electrically connected with the ground pattern 101*g* via the wire WR by soldering, pressure joining, etc. For example, the ground terminal 44 may be applied to the split-ring resonator illustrated in FIG. 18. For example, the ground terminal 44 may be applied to the split-ring resonator illustrated in FIG. 14.

Figure 23:
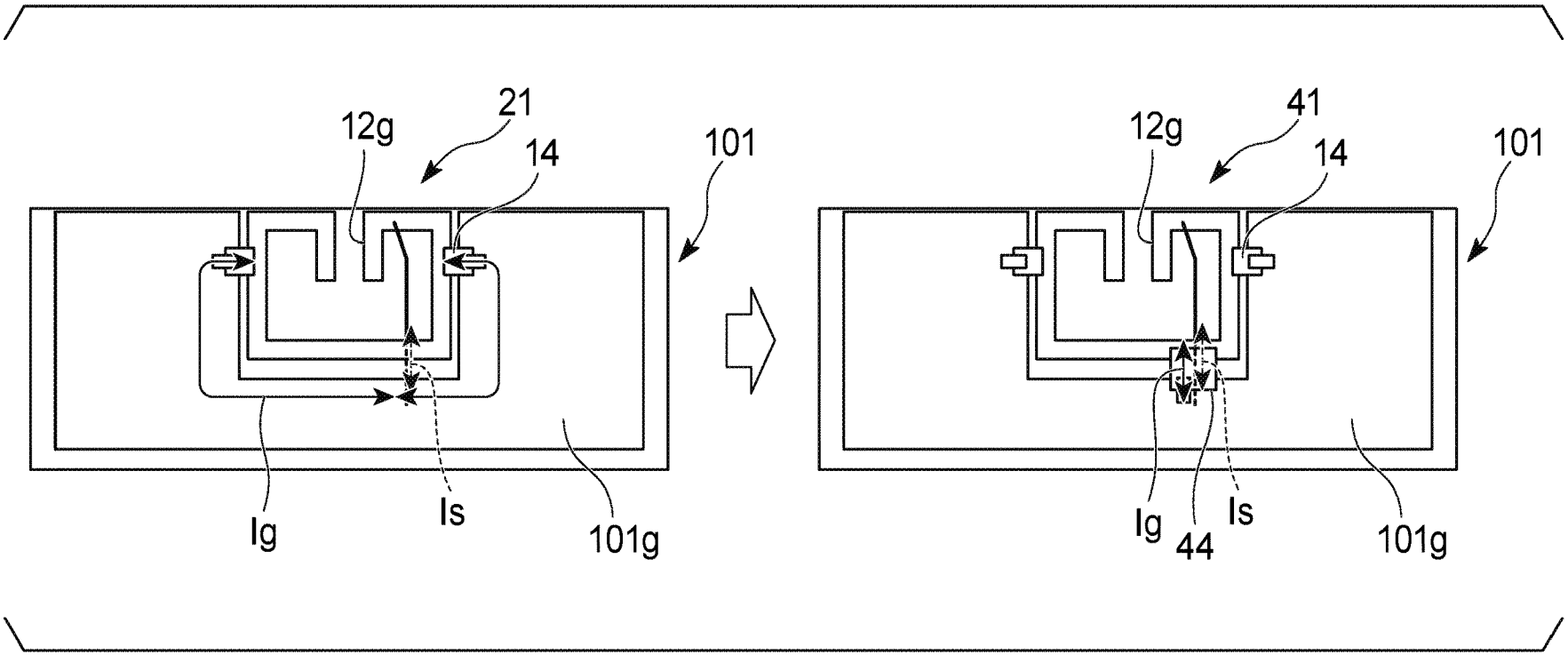
FIG. 23 is a view for comparing currents in split-ring resonators according to an aspect of the present disclosure.
Figure 24:
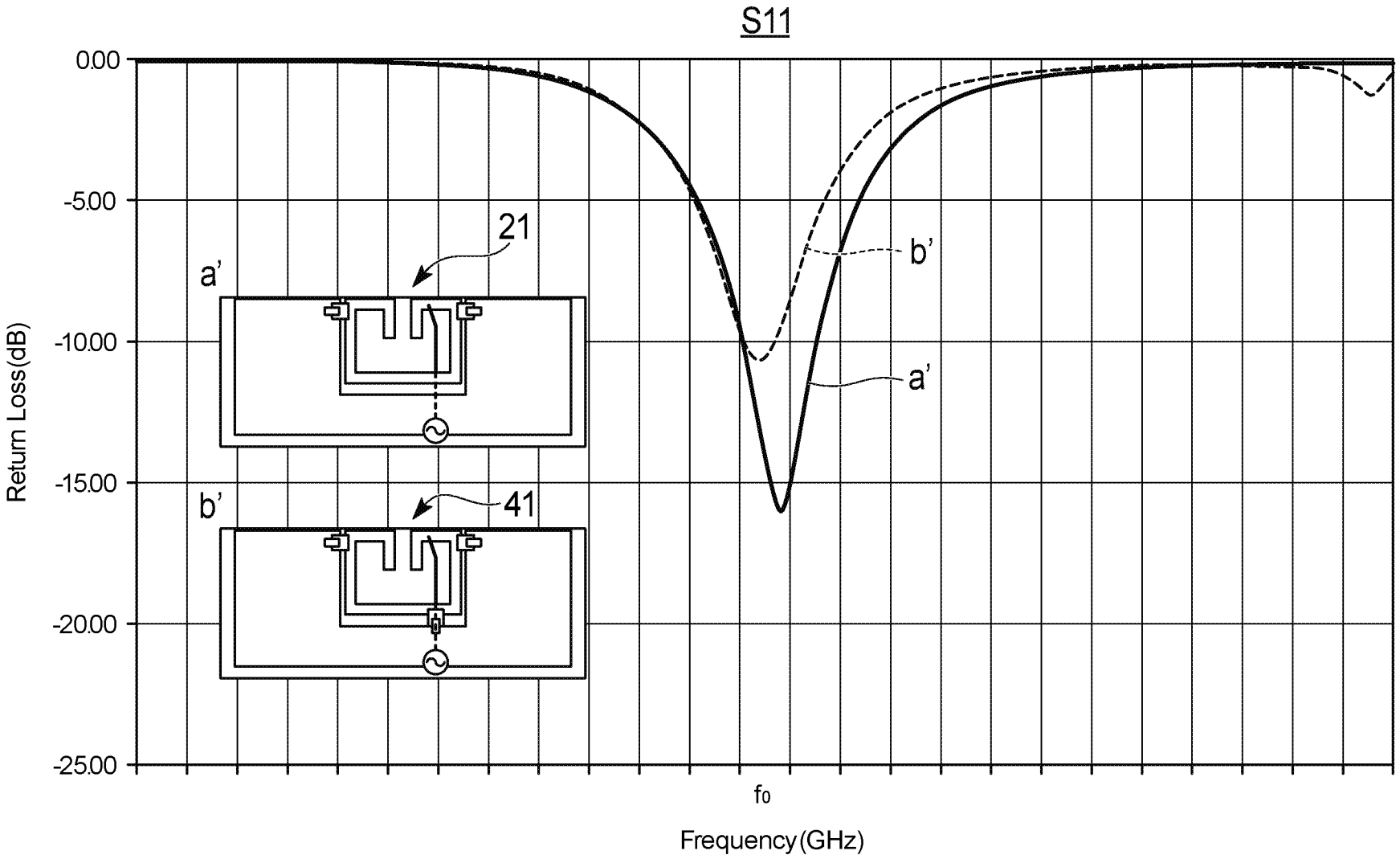
FIG. 24 is a graph showing return loss properties of split-ring resonators according to an aspect of the present disclosure.

According to the split-ring resonator 41 illustrated in FIG. 20, the ground terminal 44 for grounding of the feed current is provided on the lower section of the split-ring resonator 41. Here, it is assumed that a feeding point is located on a side of the upper section (on the first conductor 12*a* including the split portion 12*g*), and that the feeding wire WS, which is connected to the feeding point, extends to the lower section of the split-ring resonator 41 through the opening located inside the ring of the split-ring resonator 41. In this case, a return current Ig of a fed current Is is not diverted to the ground terminal 14 of the upper section but can flow from the split-ring resonator 41 directly to the ground pattern 101*g*. Accordingly, as shown in FIG. 23, the split-ring resonator 41 illustrated in FIG. 20 has less change in impedance and makes it easier to obtain matching in comparison with the split-ring resonator 21 illustrated in FIG. 12. Therefore, as shown in FIG. 24, the return loss at resonance frequency f0 of the split-ring resonator 41 illustrated in FIG. 20 is small in comparison with the split-ring resonator 21 illustrated in FIG. 12. Here, the curve a' and the curve b' show frequency characteristics of return loss of the split-ring resonator 41 and the split-ring resonator 21, respectively, under conditions different from those about FIG. 19.

The split-ring resonator 51 according to an aspect of the present disclosure is based on the split-ring resonator 21 while a first ground terminal is located on a section where the split of the split-ring resonator does not exist as viewed from the straight-line L. On the straight-line L, the point C exists, the point C being a center of a ring of the split-ring resonator. The straight-line L is perpendicular to the line segment m which connects the point C and the split to each other (see FIG. 1).

Figure 25:
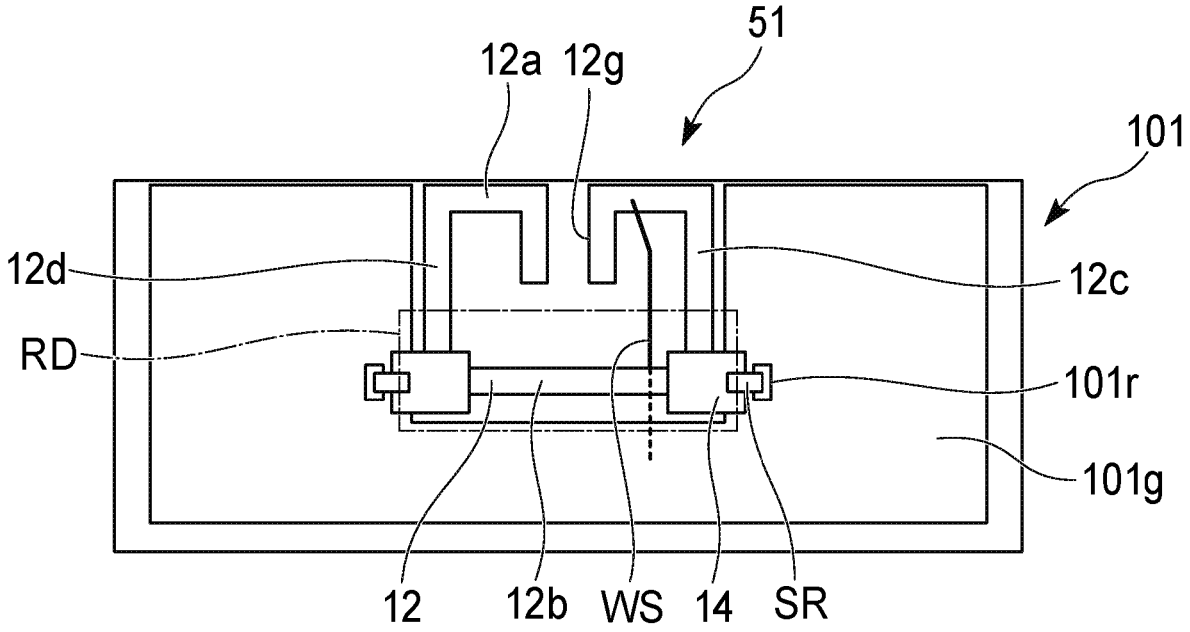
FIG. 25 is a plan view showing a split-ring resonator according to an aspect of the present disclosure.
Figure 26:
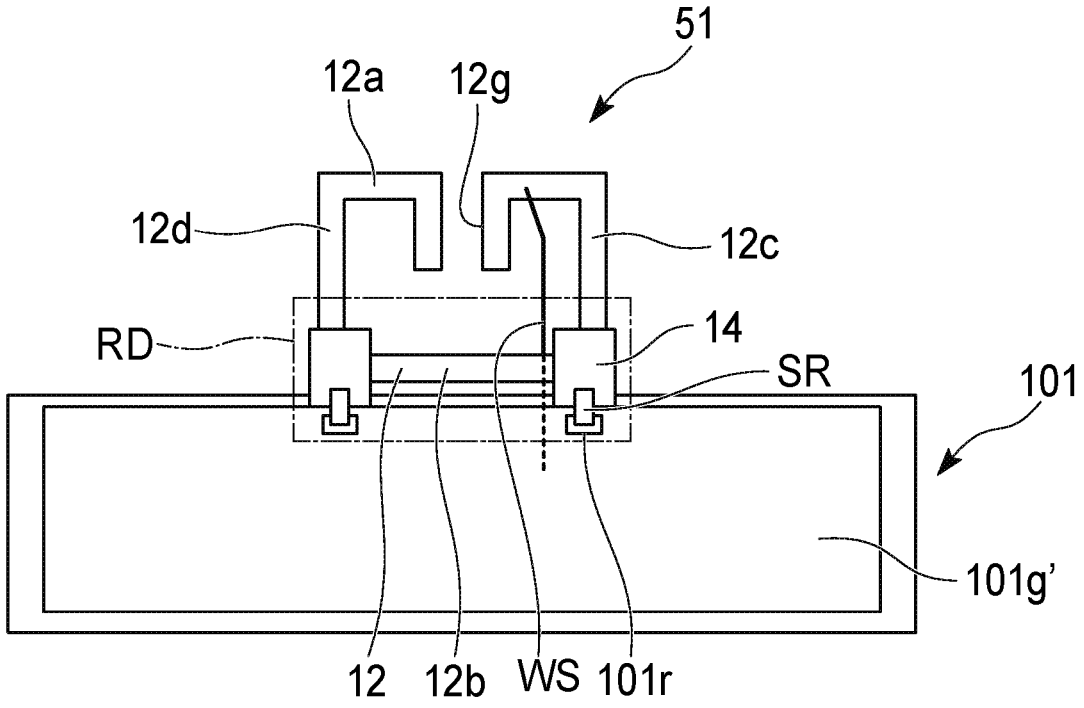
FIG. 26 is a plan view showing a split-ring resonator according to an aspect of the present disclosure.
Figure 27:
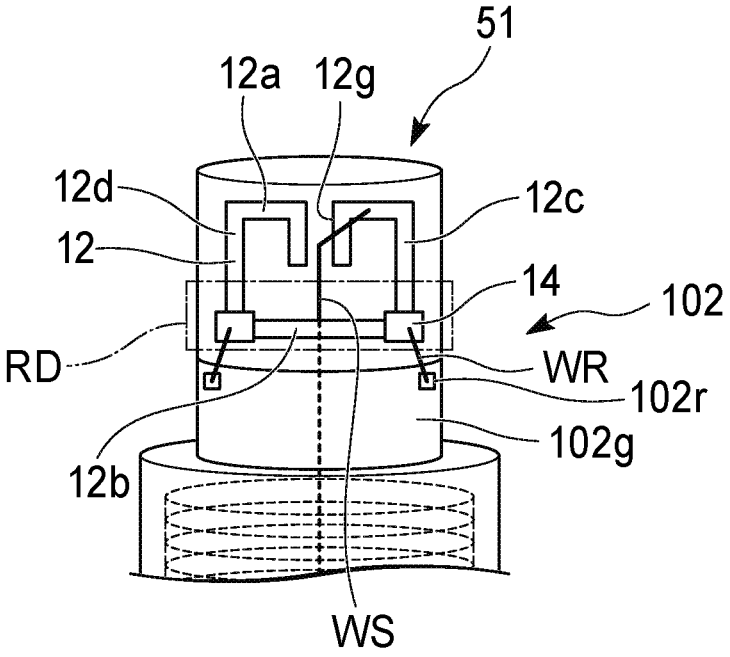
FIG. 27 is a perspective view showing a split-ring resonator according to an aspect of the present disclosure.

FIGS. 25, 26 and 27 are figures showing examples of the split-ring resonator 51 according to an aspect of the present disclosure.

For example, the split-ring resonator 51 may comprise the ground terminal 14 located on the lower section RD of the split-ring resonator 51. For example, the ground terminals 14 may be provided at positions of two corners (each of the intersection of the second conductor 12*b* and the third conductor 12*c* and the intersection of the second conductor 12*b* and the fourth conductor 12*d*) of the lower section RD of the split-ring resonator 51, respectively.

For example, although the ground terminals 14 are provided on the two corners of the lower section RD of the split-ring resonator 51, respectively, they may be provided on any positions of the lower section RD of the split-ring resonator 51. For example, the ground terminals 14 may be provided at positions of the second conductor 12*b*. For example, the ground terminals 14 may be provided at a position of each conductor of the third conductor 12*c* and the fourth conductor 12*d*, respectively.

A board according to an aspect of the present disclosure comprises a terminal configured to be connected to the ground terminal, which is separated from a ground pattern, of the split-ring resonator 51 according to an aspect of the present disclosure.

FIGS. 25 and 26 are figures showing examples of the board 101 according to an aspect of the present disclosure.

For example, the split-ring resonator 51 may be provided adjacent to an edge of the board 101. For example, the split-ring resonator 51 may be provided so that the separation direction of the split portion 12*g* is aligned with a direction along which the adjacent edge of the board 101 extends.

A connector according to an aspect of the present disclosure comprises a terminal configured to be connected to the ground terminal, which is separated from a ground pattern, of the split-ring resonator 51 according to an aspect of the present disclosure.

FIG. 27 is a figure showing an example of the connector 102 according to an aspect of the present disclosure.

For example, the split-ring resonator 51 is provided to the connector 102 to be adjacent to the ground pattern 102*g*. For example, the split-ring resonator 51 may be provided so that the separation direction of the split portion 12*g* is aligned with the radial direction of the connector 102. For example, the ground terminals 14 may be connected to the ground pattern 102*g* via the wires WR.

Figure 28:
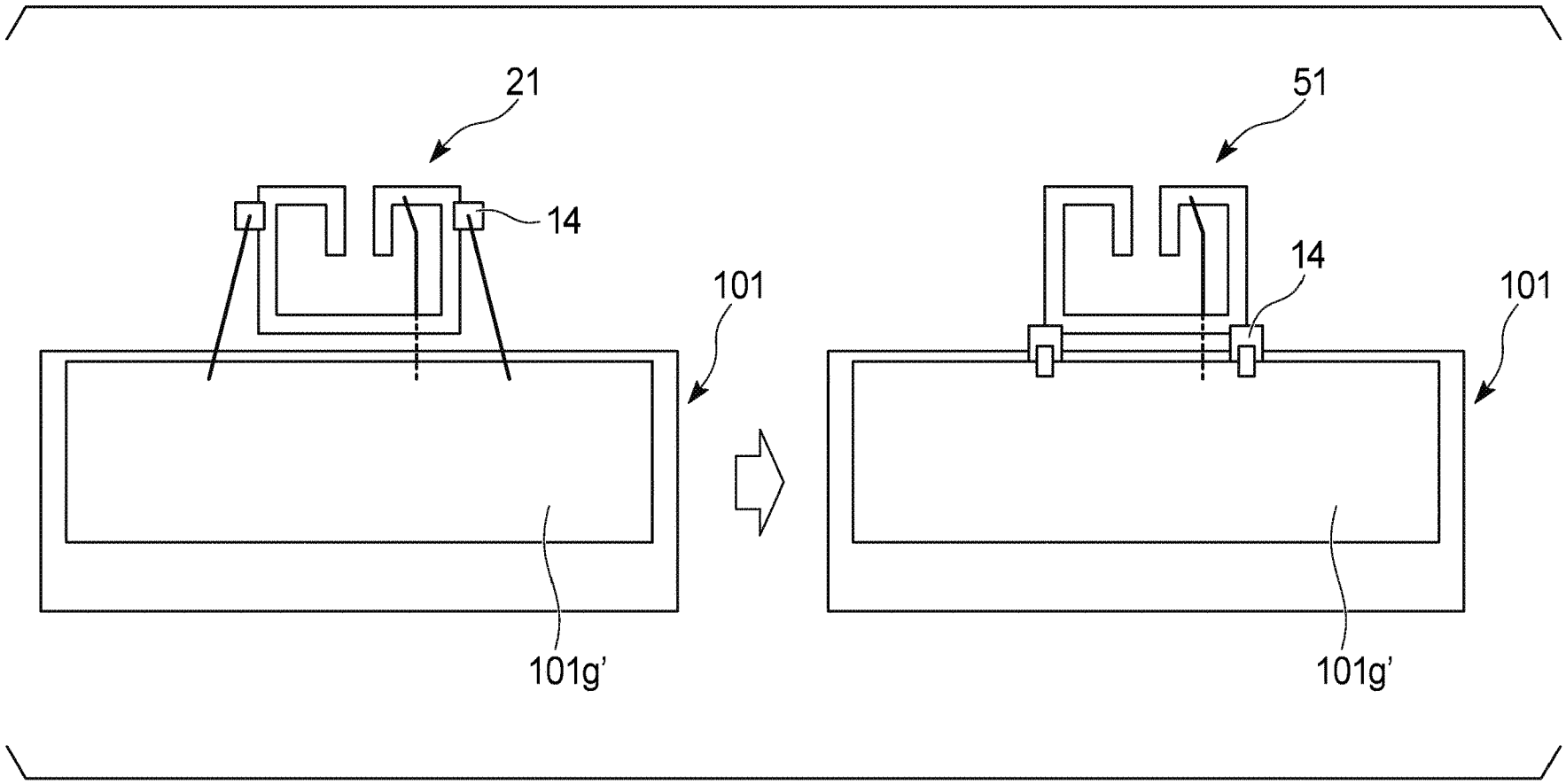
FIG. 28 is a view for comparing connection configurations each of which is between a split-ring resonator and a board according to an aspect of the present disclosure.

It is assumed that the split portion 12*g* is directed to a direction different from another direction along which the ground pattern 101*g*' of the board 101 is located. In this case, as shown in FIG. 28, when being connected to the ground pattern 101*g*' having no opening, the split-ring resonator 51 having the ground terminal 14 located on the lower section as illustrated in FIG. 26 can be connected to the ground pattern 101*g*' by a distance shorter than that of the split-ring resonator 21 illustrated in FIG. 13. Therefore, the split-ring resonator 51 illustrated in FIG. 26 is more easily connected to the board 101 than the split-ring resonator 21 illustrated in FIG. 13 because of its structure.

Figure 29:
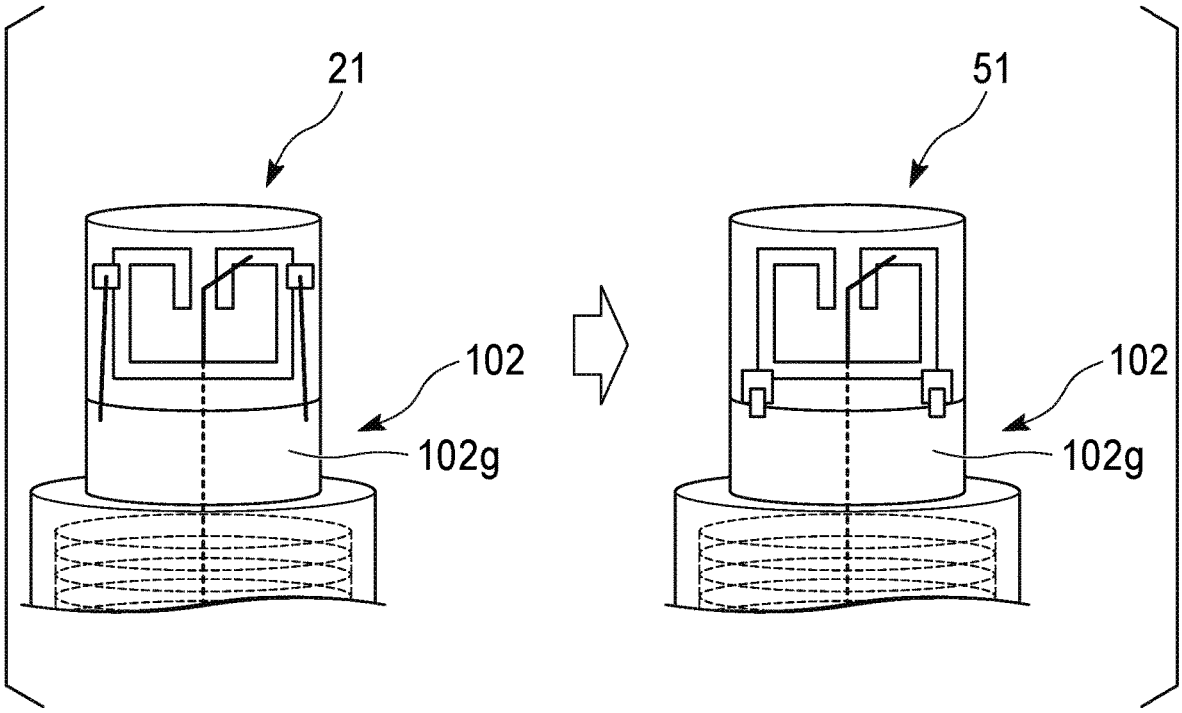
FIG. 29 is a view for comparing connection configurations each of which is between a split-ring resonator and a connector according to an aspect of the present disclosure.

It is assumed that the split portion 12*g* is directed to a direction different from another direction along which the ground pattern 102*g* of the connector 102 is located. In this case, as shown in FIG. 29, the split-ring resonator 51 having the ground terminals located on the lower section as illustrated in FIG. 27 can be connected to the ground pattern 102*g* by a distance shorter than that of the split-ring resonator 21 illustrated in FIG. 14. Therefore, the split-ring resonator 51 illustrated in FIG. 27 is more easily connected to the connector 102 than the split-ring resonator 21 illustrated in FIG. 14 because of its structure.

A split-ring resonator 61 according to an aspect of the present disclosure is based on the split-ring resonator 51 while comprising a radiation conductor.

Figure 30:
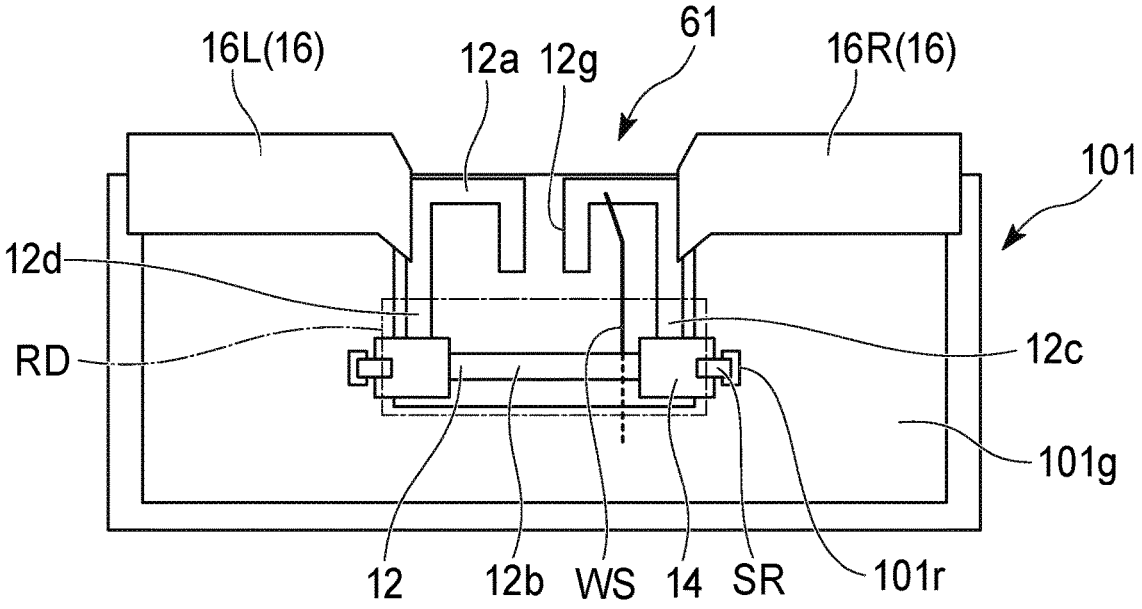
FIG. 30 is a plan view showing a split-ring resonator according to an aspect of the present disclosure.
Figure 31:
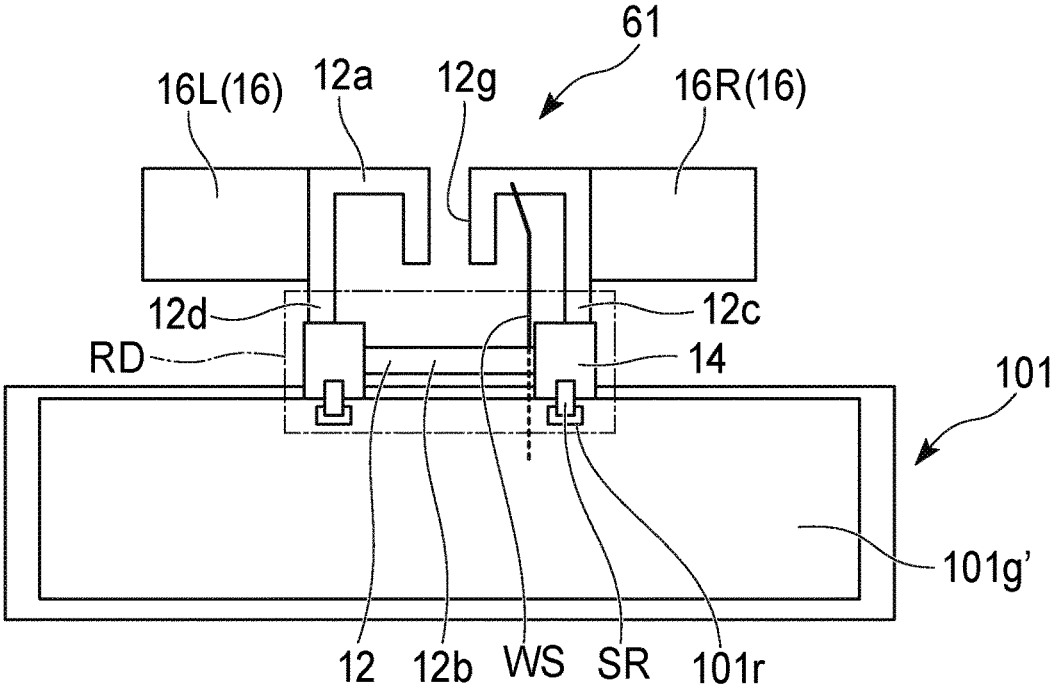
FIG. 31 is a plan view showing a split-ring resonator according to an aspect of the present disclosure.
Figure 32:
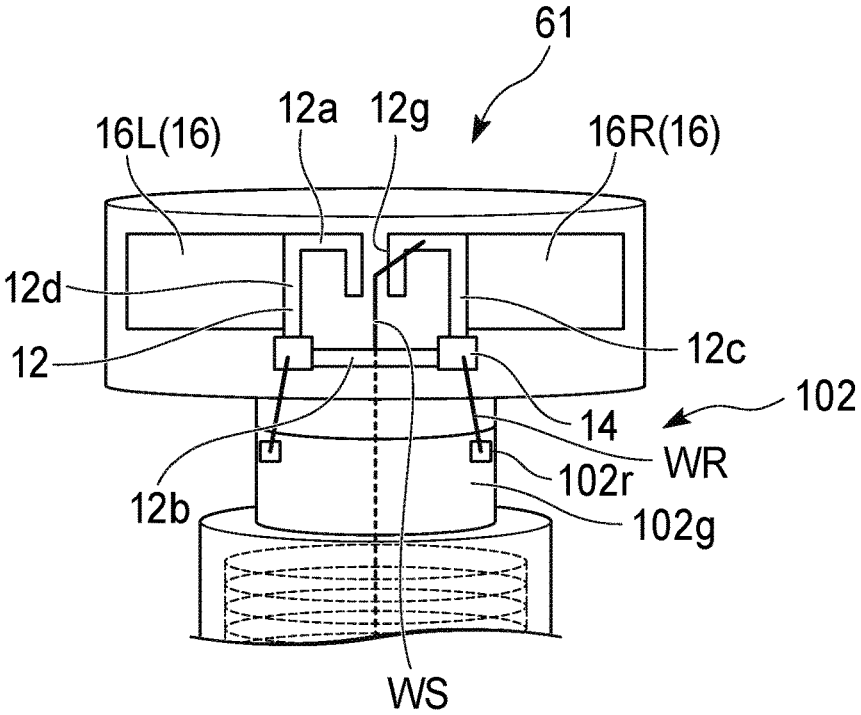
FIG. 32 is a perspective view showing a split-ring resonator according to an aspect of the present disclosure.

FIGS. 30, 31 and 32 are figures showing examples of the split-ring resonator 61 according to an aspect of the present disclosure.

For example, the split-ring resonator 61 may comprise radiation conductors 16. For example, the split-ring resonator 61 may comprise a pair of radiation conductors 16 (a radiation conductor 16R and a radiation conductor 16L) which are apart from each other and face each other in the separation direction of the split portion 12*g*. For example, the radiation conductor 16R and the radiation conductor 16L may extend so as to be away from each other in the separation direction. For example, each of the radiation conductor 16R and radiation conductor 16L may be formed of a metal plate having a plate-like shape extending in the separation direction. For example, the radiation conductors 16 may be provided on the upper section RU of the split-ring resonator 61. For example, the radiation conductor 16R may be connected to the third conductor 12*c*. For example, the radiation conductor 16L may be connected to the fourth conductor 12*d*. For example, an end of each of the radiation conductor 16R and the radiation conductor 16L, which is connected to the split-ring 12, may further extend in a direction intersecting with a plane in which the ground pattern 101*g* extends so that the radiation conductor 16R and the radiation conductor 16L are not brought into contact with the ground pattern 101*g*.

A board according to an aspect of the present disclosure comprises a terminal configured to be connected to the ground terminal, which is separated from a ground pattern, of the split-ring resonator 61 according to an aspect of the present disclosure.

FIGS. 30 and 31 are figures showing examples of the board 101 according to an aspect of the present disclosure.

For example, the split-ring resonator 61 may be provided adjacent to an edge of the board 101. For example, the split-ring resonator 61 may be provided so that the separation direction of the split portion 12*g* is aligned with a direction along which the adjacent edge of the board 101 extends.

A connector according to an aspect of the present disclosure comprises a terminal configured to be connected to the ground terminal, which is separated from a ground pattern, of the split-ring resonator 61 according to an aspect of the present disclosure.

FIG. 32 is a figure showing an example of the connector 102 according to an aspect of the present disclosure.

For example, the split-ring resonator 61 may be provided to the connector 102 to be adjacent to the ground pattern 102*g*. For example, the split-ring resonator 61 may be provided so that the separation direction of the split portion 12*g* is aligned with the radial direction of the connector 102. For example, the ground terminals 14 may be connected to the ground pattern 102*g* via the wires WR.

Figure 33:
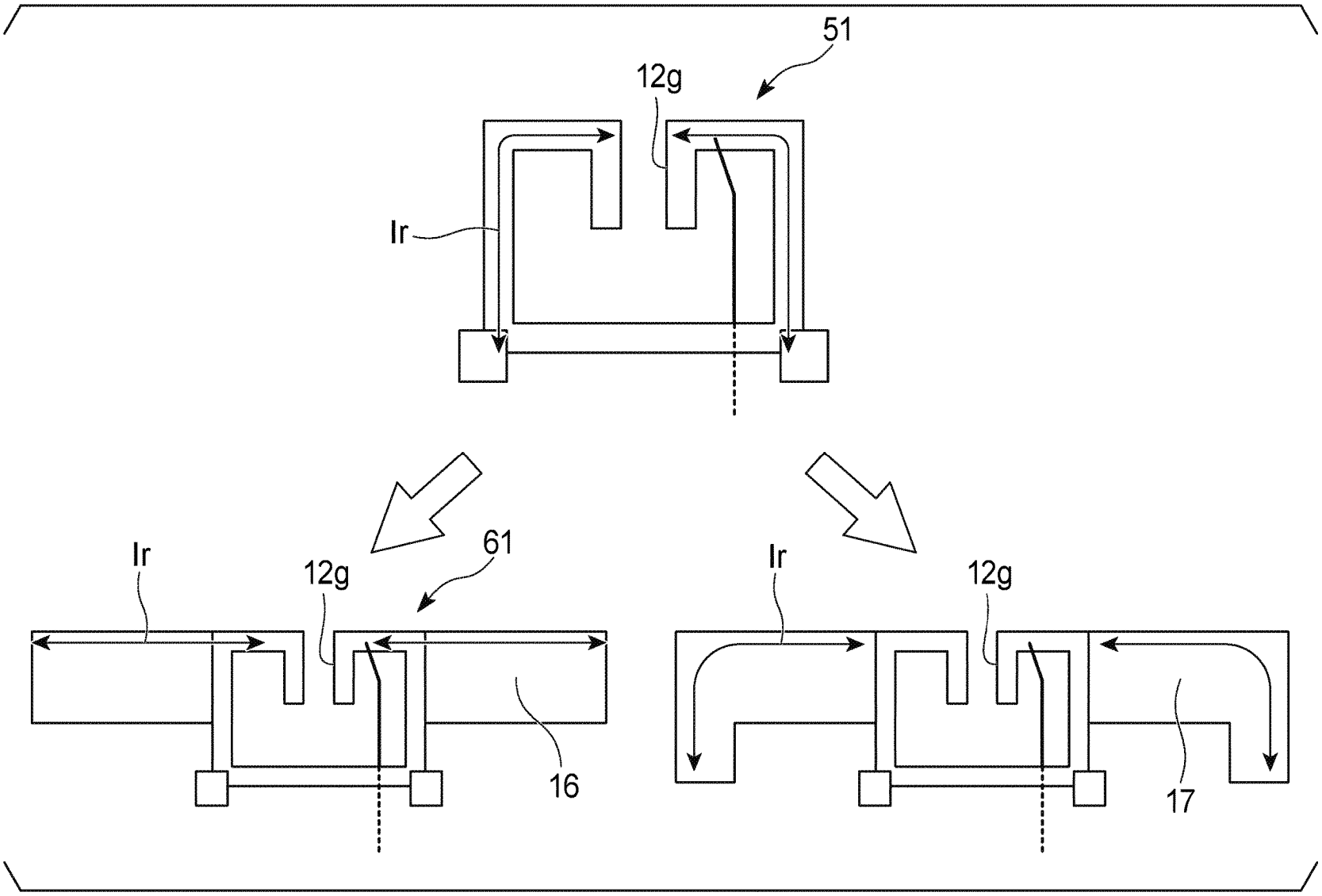
FIG. 33 is a view for explaining about currents in radiating conductors.

The current Ir which contributes for radiation tends to flow in the separation direction of the split portion 12*g*. Accordingly, as shown in the lower left of FIG. 33, since the split-ring resonator 61 illustrated in FIG. 30 comprises the radiation conductors 16 extending in the separation direction, the current Ir flows onto the radiation conductors 16. Therefore, the split-ring resonator 61 illustrated in FIG. 30 has an improved radiation property in comparison with the split-ring resonator 51 illustrated in FIG. 25. Moreover, for example, as shown in the lower right of FIG. 33, the split-ring resonator 61 may comprise L-like shaped radiation conductors 17 as radiation conductors, the radiation conductor 17 extending in the separation direction to an end and then extending from the end in a direction intersecting with the separation direction along a plane in which the split-ring resonator 61 extends. The comparison of the split-ring resonator 61 illustrated in FIG. 31 with the split-ring resonator 51 illustrated in FIG. 26 comes to a similar conclusion. Also, the comparison of the split-ring resonator 61 illustrated in FIG. 32 with the split-ring resonator 51 illustrated in FIG. 27 comes to a similar conclusion.

A split-ring resonator 71 according to an aspect of the present disclosure is based on the split-ring resonator 21 while all ground terminals including the previously described first ground terminal are located on one of opposite sections across the straight-line M. The straight-line M is a straight-line including a line segment which connects the point C and the split of the split-ring resonator to each other, the point C being a center of a ring of the split-ring resonator (see FIG. 1).

Figure 34:
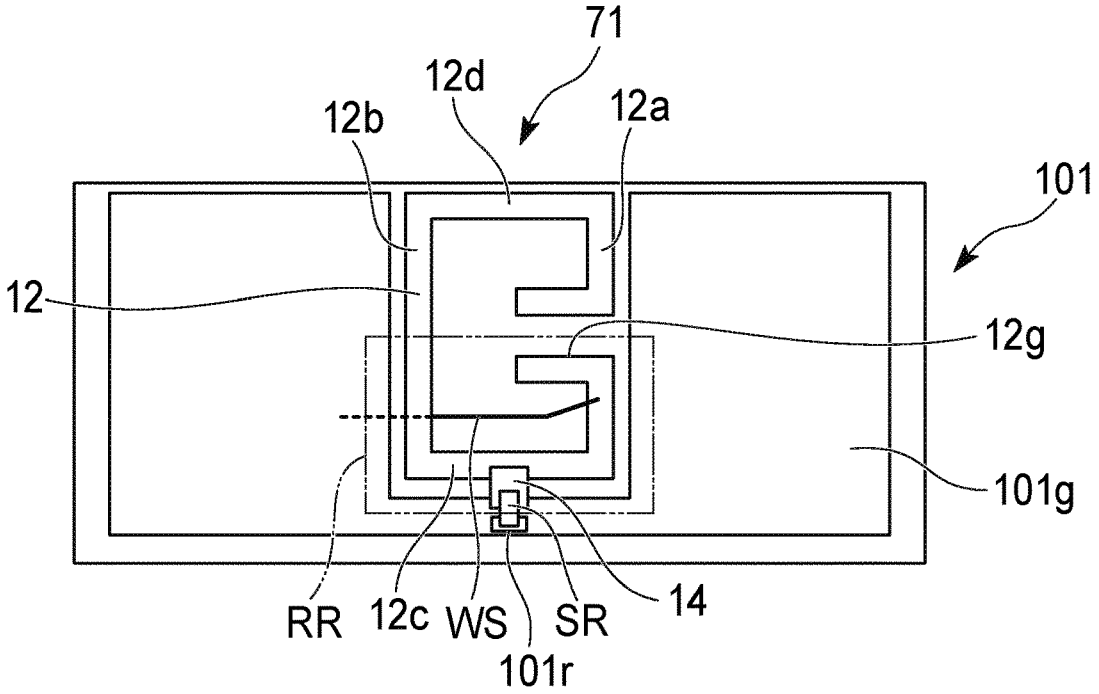
FIG. 34 is a plan view showing a split-ring resonator according to an aspect of the present disclosure.
Figure 35:
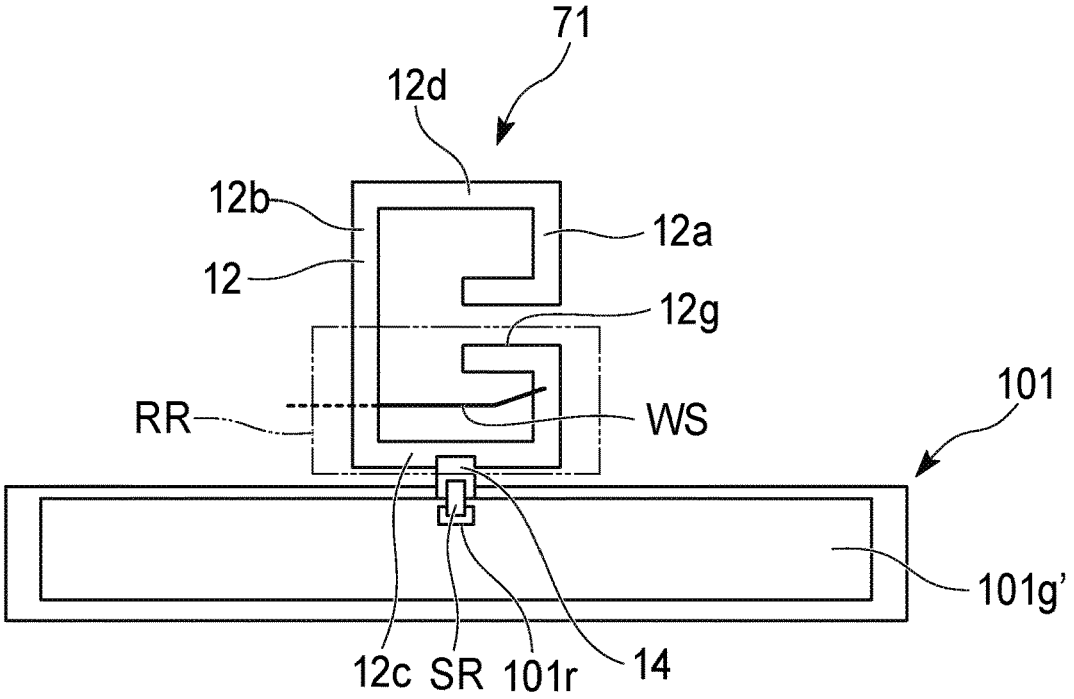
FIG. 35 is a plan view showing a split-ring resonator according to an aspect of the present disclosure.
Figure 36:
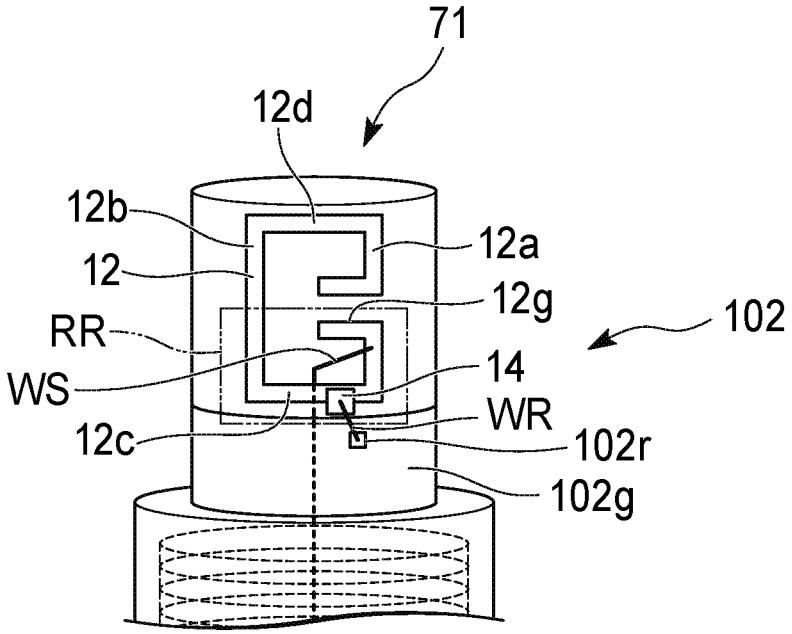
FIG. 36 is a perspective view showing a split-ring resonator according to an aspect of the present disclosure.

FIGS. 34, 35 and 36 are figures showing examples of the split-ring resonator 71 according to an aspect of the present disclosure.

For example, the split-ring resonator 71 may comprise the ground terminal 14 located either on the right section RR or on the left section RL of the split-ring resonator 71. For example, the ground terminal 14 may be provided on the right section RR of the split-ring resonator 71. Also, for example, the ground terminal 14 may be provided at a position of the third conductor 12*c*. For example, the ground terminal 14 may be connected to the third conductor 12*c*. For example, the split-ring resonator 71 is provided to the opening 101*a* so that the separation direction of the split portion 12*g* intersects with the direction along which the opening 101*a* is widen. The ground terminal 14 may be located in the opening 101*a* and may be connected to an edge of the ground pattern 101*g* which extends in the direction along which the opening 101*a* is widen.

For example, although the ground terminal 14 is provided on the third conductor 12*c*, it may be provided at any position of either the right section RR or the left section RL of the split-ring resonator 71. For example, the ground terminal 14 may be provided at a position of the first conductor 12*a*. In this case, the ground terminal 14 may be connected to the first conductor 12*a*. For example, the ground terminal 14 may be provided at a position of the second conductor 12*b*. In this case, the ground terminal 14 may be connected to the second conductor 12*b*.

A board according to an aspect of the present disclosure comprises a terminal configured to be connected to the ground terminal, which is separated from a ground pattern, of the split-ring resonator 71 according to an aspect of the present disclosure.

FIGS. 34 and 35 are figures showing examples of the board 101 according to an aspect of the present disclosure.

For example, the split-ring resonator 71 may be provided adjacent to an edge of the board 101. For example, the split-ring resonator 71 may be provided so that a cutting direction of the split portion 12*g* is aligned with a direction along which the adjacent edge of the board 101 extends.

A connector according to an aspect of the present disclosure comprises a terminal configured to be connected to the ground terminal, which is separated from a ground pattern, of the split-ring resonator 71 according to an aspect of the present disclosure.

FIG. 36 is a figure showing an example of the connector 102 according to an aspect of the present disclosure.

For example, the split-ring resonator 71 may be provided to the connector 102 to be adjacent to the ground pattern 102*g*. For example, the split-ring resonator 71 may be provided so that the cutting direction of the split portion 12*g* is aligned with the radial direction of the connector 102. For example, the ground terminal 14 may be connected to the ground pattern 102*g* via the wire WR.

Figure 37:
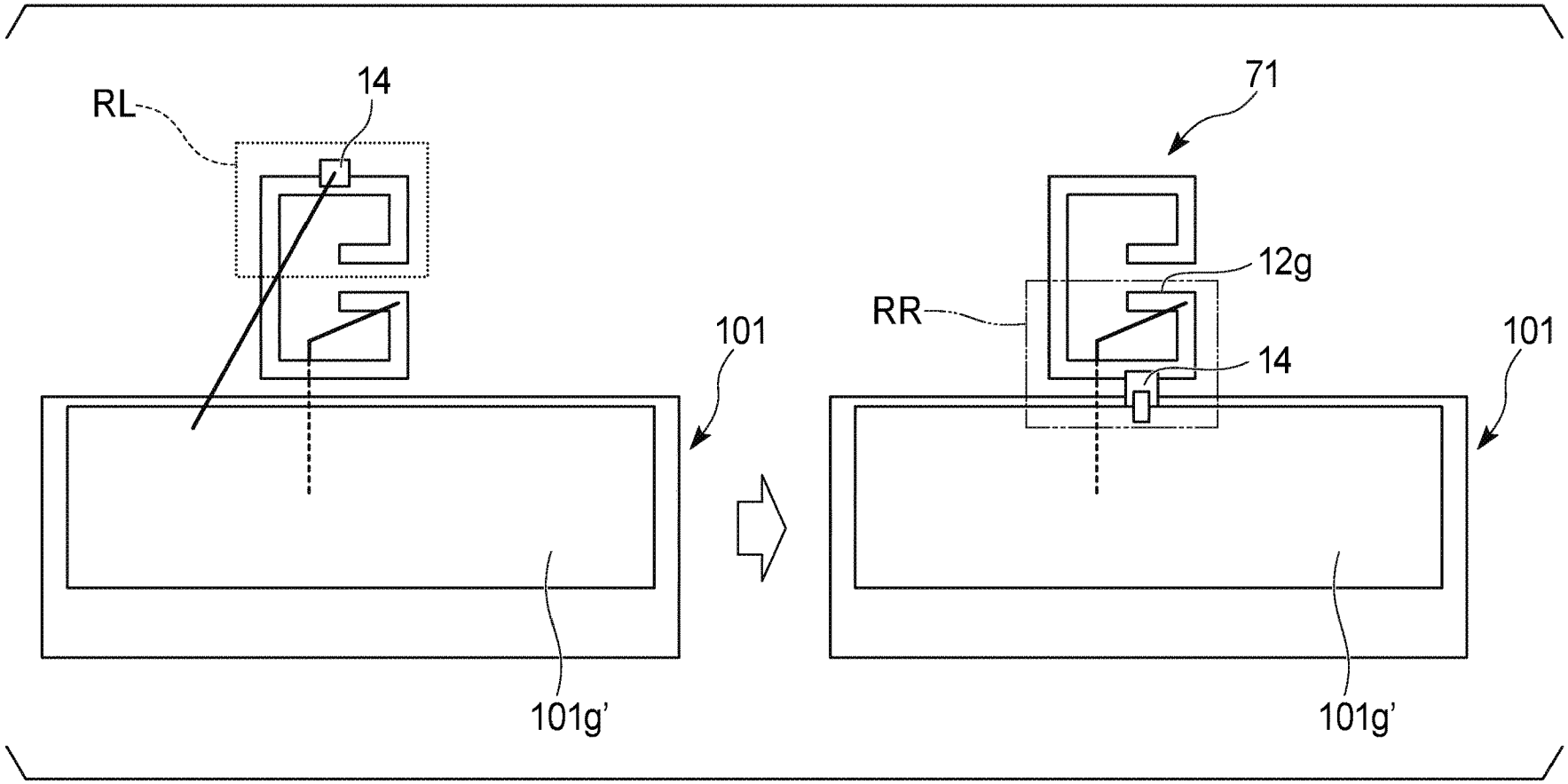
FIG. 37 is a view for comparing connection configurations each of which is between a split-ring resonator and a board according to an aspect of the present disclosure.

The split-ring resonator 71 illustrated in FIG. 34 can be easily connected to the ground pattern 101*g*' when the ground terminal 14 is provided on either the right section RR or the left section RL of the split-ring resonator 71. In particular, as shown in the right of FIG. 37, when the right section RR of the split-ring resonator 71 is adjacent to an edge of the ground pattern 101*g*', the connection is made easier in a case where the ground terminal 14 is provided on the right section RR of the split-ring resonator 71 in comparison with another case where the ground terminal 14 is provided on the left section RL (a comparative example illustrated in the left of FIG. 37).

A split-ring resonator 81 according to an aspect of the present disclosure is based on the split-ring resonator 71 while the first ground terminal is located on a section where the split exists as viewed from the straight-line L. On the straight-line L, the point C exists, and the straight-line L is perpendicular to the line segment m which connects the point C and the split to each other.

Figure 38:
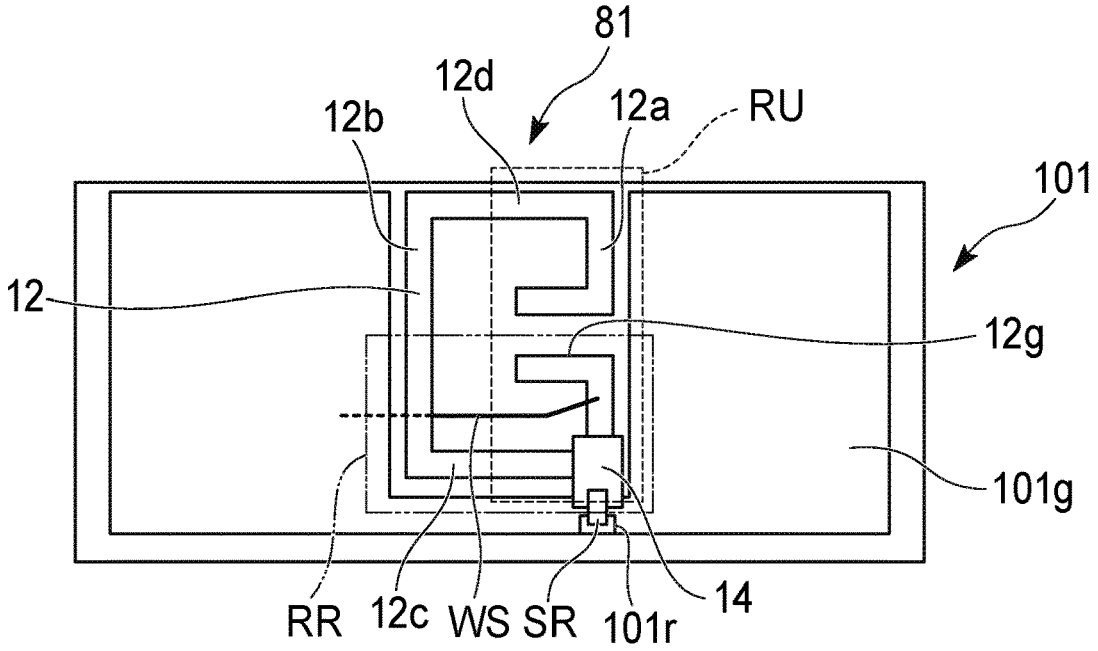
FIG. 38 is a plan view showing a split-ring resonator according to an aspect of the present disclosure.
Figure 39:
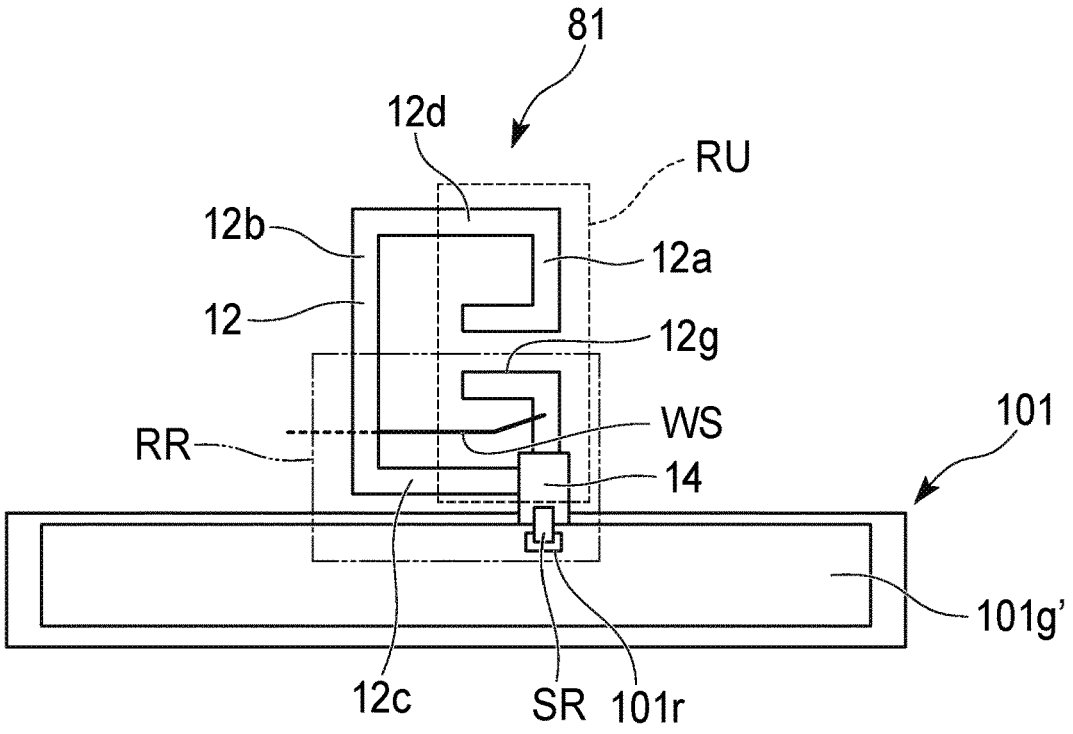
FIG. 39 is a plan view showing a split-ring resonator according to an aspect of the present disclosure.
Figure 40:
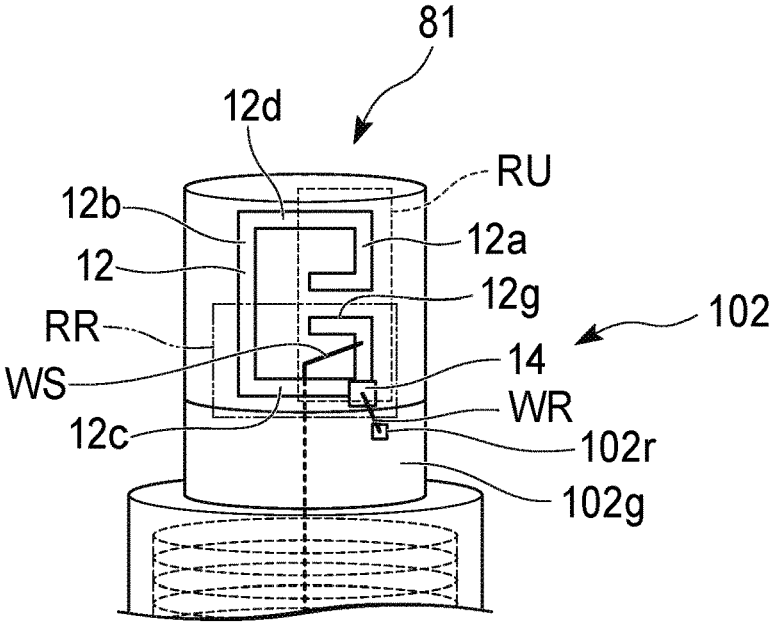
FIG. 40 is a perspective view showing a split-ring resonator according to an aspect of the present disclosure.

FIGS. 38, 39 and 40 are figures showing examples of the split-ring resonator 81 according to an aspect of the present disclosure.

For example, the split-ring resonator 81 may comprise the ground terminal 14 located on either the right section RR or the left section RL of the split-ring resonator 81, for example, on the right section RR of the split-ring resonator 81. For example, the ground terminal 14 may be provided on the right section RR of the split-ring resonator 81 and on the upper section RU of the split-ring resonator 81.

A board according to an aspect of the present disclosure comprises a terminal configured to be connected to the ground terminal, which is separated from a ground pattern, of the split-ring resonator 81 according to an aspect of the present disclosure.

FIGS. 38 and 39 are figures showing examples of the board 101 according to an aspect of the present disclosure.

For example, the split-ring resonator 81 may be provided adjacent to an edge of the board 101. For example, the split-ring resonator 81 may be provided so that the cutting direction of the split portion 12*g* is aligned with a direction along which the adjacent edge of the board 101 extends.

A connector according to an aspect of the present disclosure comprises a terminal configured to be connected to the ground terminal, which is separated from a ground pattern, of the split-ring resonator 81 according to an aspect of the present disclosure.

FIG. 40 is a figure showing an example of the connector 102 according to an aspect of the present disclosure.

For example, the split-ring resonator 81 may be provided to the connector 102 to be adjacent to the ground pattern 102*g*. For example, the split-ring resonator 81 may be provided so that the cutting direction of the split portion 12*g* is aligned with the radial direction of the connector 102. For example, the ground terminal 14 may be connected to the ground pattern 102*g* via the wire WR.

According to the split-ring resonator 81 illustrated in FIG. 38, the current Ir which contributes for radiation more easily flow in the upper section of the split-ring resonator 81 illustrated in FIG. 38 in comparison with the split-ring resonator 71 illustrated in FIG. 34. Therefore, according to the split-ring resonator 81 illustrated in FIG. 38, the current easily flows into the ground pattern 101*g*' through the ground terminal 14 in comparison with the split-ring resonator 71 illustrated in FIG. 34, so that the radiation property can be improved. The comparison of the split-ring resonator 81 illustrated in FIG. 39 with the split-ring resonator 71 illustrated in FIG. 35 comes to a similar conclusion. Also, the comparison of the split-ring resonator 81 illustrated in FIG. 40 with the split-ring resonator 71 illustrated in FIG. 36 comes to a similar conclusion.

A split-ring resonator 91 according to an aspect of the present disclosure is based on the split-ring resonator 71 or the split-ring resonator 81 while comprising a radiation conductor located on a section where the first conductor does not exist as viewed from the straight-line M.

Figure 41:
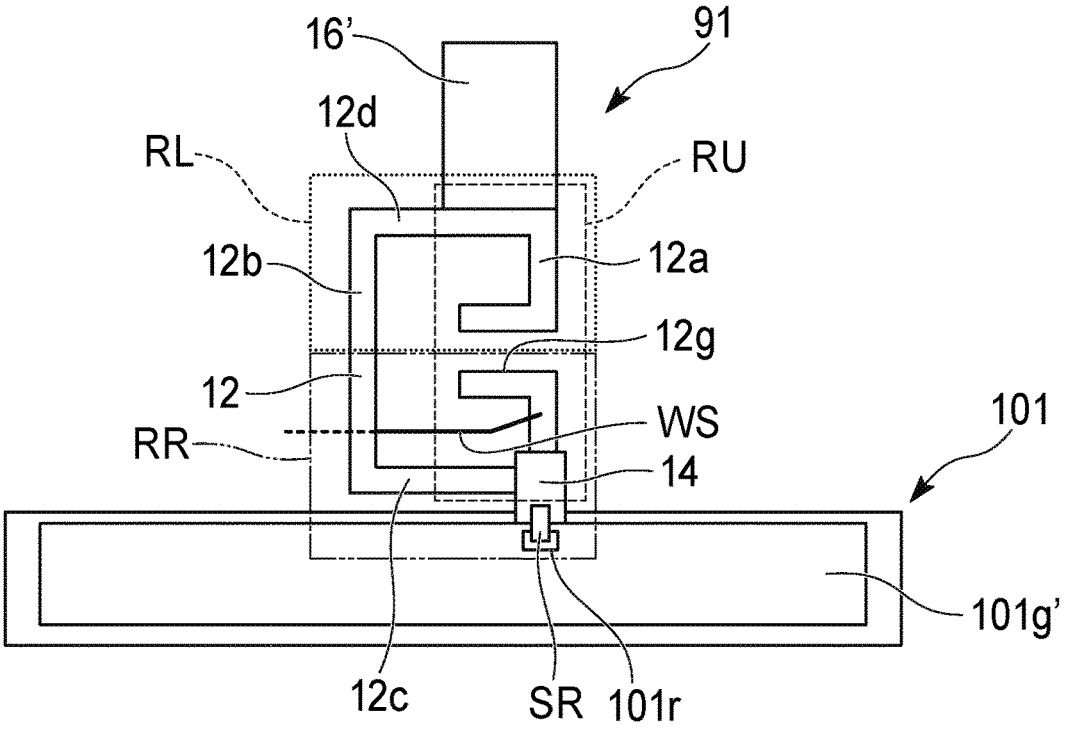
FIG. 41 is a plan view showing a split-ring resonator according to an aspect of the present disclosure.
Figure 42:
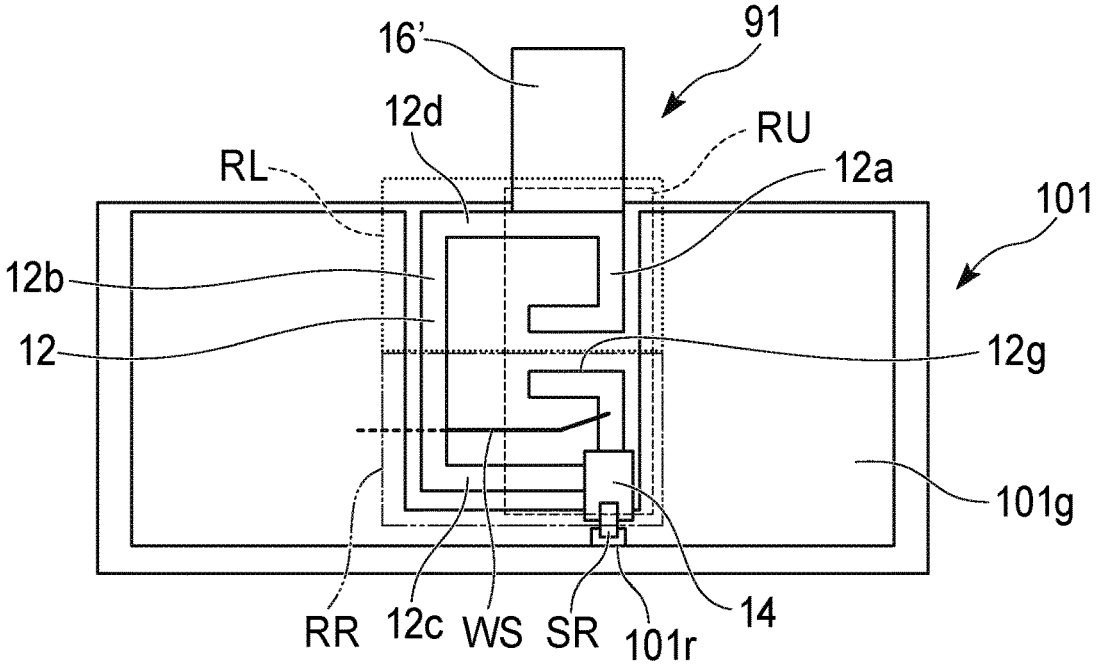
FIG. 42 is a plan view showing a split-ring resonator according to an aspect of the present disclosure.
Figure 43:
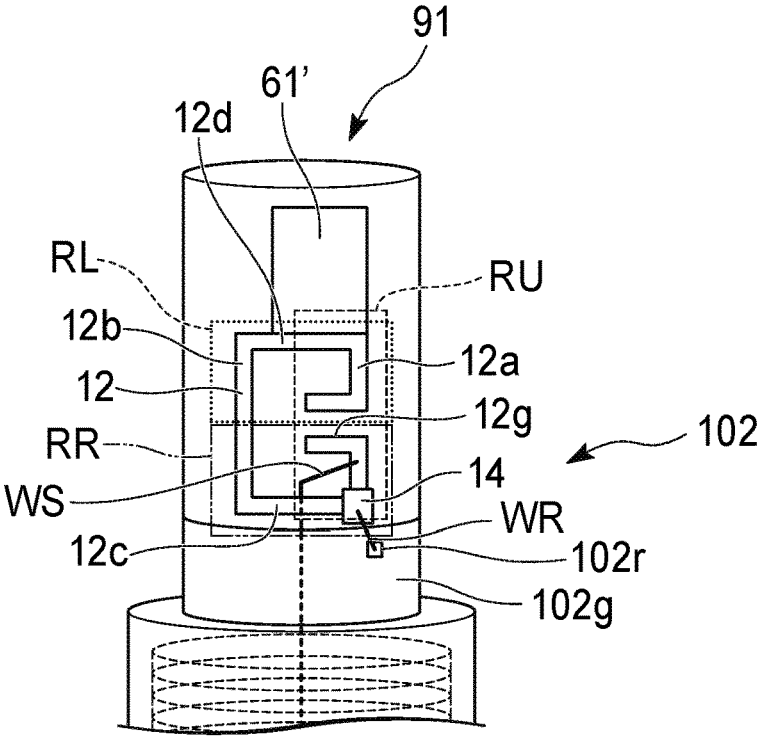
FIG. 43 is a perspective view showing a split-ring resonator according to an aspect of the present disclosure.

FIGS. 41, 42 and 43 are figures showing examples of the split-ring resonator 91 according to an aspect of the present disclosure.

For example, the split-ring resonator 91 may comprise a radiation conductor 16'. For example, the split-ring resonator 91 may comprise the radiation conductor 16' located on one of the right section RR and the left section RL of the split-ring resonator 91, the one of the right section RR and the left section RL being located opposite to a remaining one where the ground terminal 14 is provided. For example, the split-ring resonator 91 may comprise the radiation conductor 16' located on the left section RL of the split-ring resonator 91 and located on the upper section RU of the split-ring resonator 91. For example, the radiation conductor 16' may be connected to the fourth conductor 12*d*. For example, the radiation conductor 16' may extend in the separation direction from an end connected to the split-ring 12 so as to be away from the fourth conductor 12*d*. For example, the radiation conductor 16' may be formed of a metal plate having a plate-like shape extending from the split-ring 12 in the separation direction.

For example, the ground terminal 14 may be provided at any position of either the right section RR or the left section RL of the split-ring resonator 91. For example, the ground terminal 14 may be provided on either the right section RR or the left section RL of the split-ring resonator 91, for example, on the lower section RD of the split-ring resonator 91.

A board according to an aspect of the present disclosure comprises a terminal configured to be connected to the ground terminal, which is separated from a ground pattern, of the split-ring resonator 91 according to an aspect of the present disclosure.

FIGS. 41 and 42 are figures showing examples of the board 101 according to an aspect of the present disclosure.

For example, the split-ring resonator 91 may be provided adjacent to an edge of the board 101. For example, the split-ring resonator 91 may be provided so that the cutting direction of the split portion 12*g* is aligned with a direction along which the adjacent edge of the board 101 extends.

A connector according to an aspect of the present disclosure comprises a terminal configured to be connected to the ground terminal, which is separated from a ground pattern, of the split-ring resonator 91 according to an aspect of the present disclosure.

FIG. 43 is a figure showing an example of the connector 102 according to an aspect of the present disclosure.

For example, the split-ring resonator 91 may be provided to the connector 102 to be adjacent to the ground pattern 102*g*. For example, the split-ring resonator 91 may be provided so that the cutting direction of the split portion 12*g* is aligned with the radial direction of the connector 102. For example, the ground terminal 14 may be connected to the ground pattern 102*g* via the wire WR.

Figure 44:
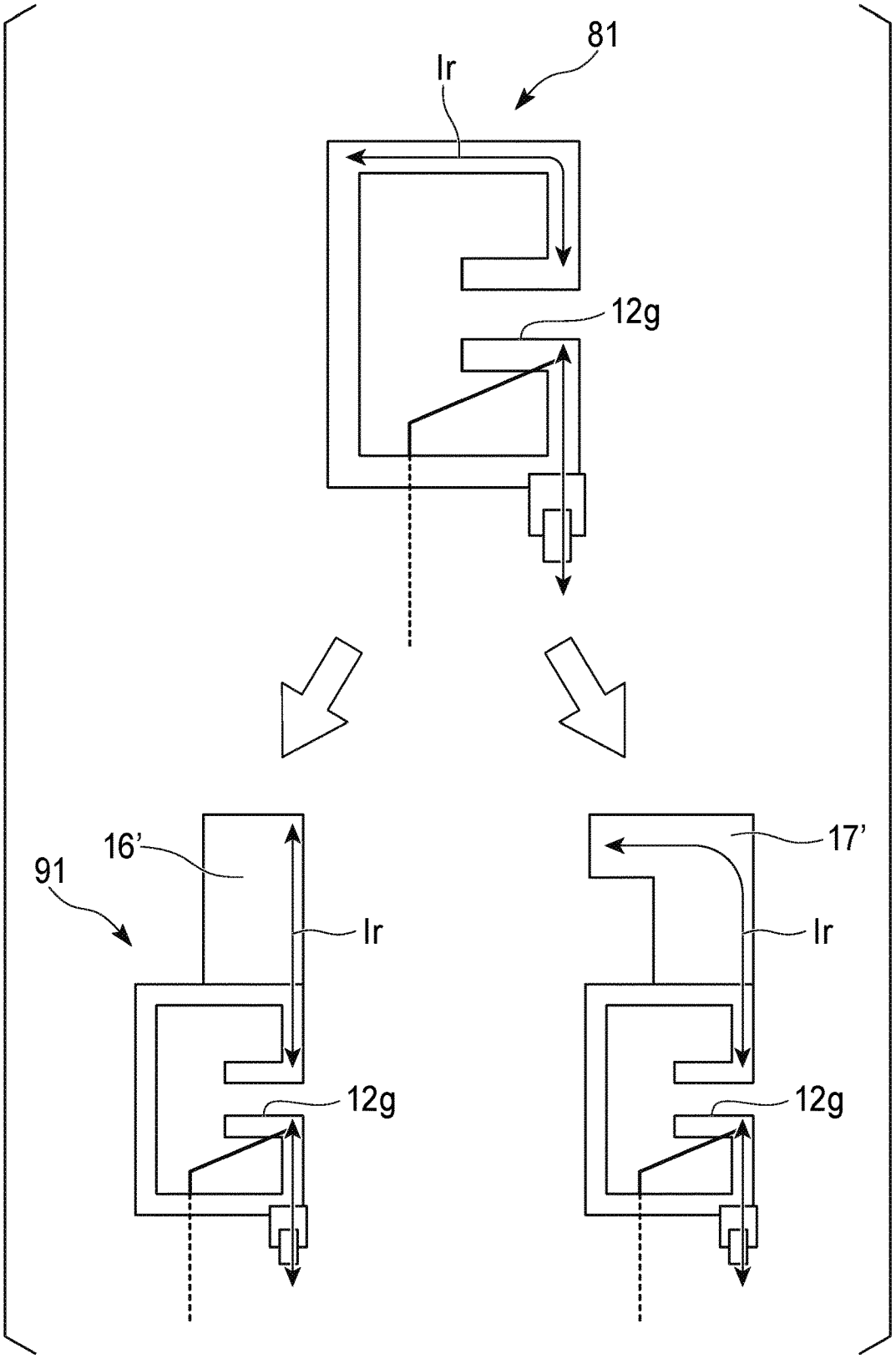
FIG. 44 is a plan view showing currents in radiating conductors according to an aspect of the present disclosure.

The current Ir which contributes for radiation tends to flow in the separation direction of the split portion 12*g*. Accordingly, as shown in the lower left of FIG. 44, since the split-ring resonator 91 illustrated in FIG. 41 comprises the radiation conductor 16' extending in the separation direction, the current Ir flows onto the radiation conductor 16'. Therefore, the split-ring resonator 91 illustrated in FIG. 41 has an improved radiation property in comparison with the split-ring resonator 81 illustrated in FIG. 38. Moreover, as shown in the lower right of FIG. 44, for example, the split-ring resonator 91 may comprise an L-like shaped radiation conductor 17' as a radiation conductor, the radiation conductor 17' extending in the separation direction to an end and then extending from the end in a direction intersecting with the separation direction along a plane in which the split-ring resonator 91 extends. The comparison of the split-ring resonator 91 illustrated in FIG. 42 with the split-ring resonator 81 illustrated in FIG. 39 comes to a similar conclusion. Also, the comparison of the split-ring resonator 91 illustrated in FIG. 43 with the split-ring resonator 81 illustrated in FIG. 40 comes to a similar conclusion.

While there has been described various embodiments, these embodiments are disclosed as examples and are not intended to limit the scope of the present invention. These embodiments can be implemented into further various modifications while various omissions, replacements and changes are made thereto without departing from the spirit of the invention. These embodiments and their modifications are within the scope and the spirit of the present invention as well as within the invention described in Claims or the invention equivalent thereto.

Figure 45:
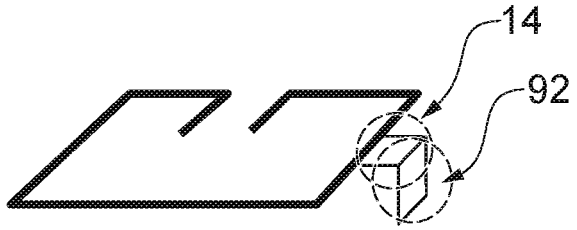
FIG. 45 is a perspective view showing an example configuration for connecting a split-ring resonator according to an embodiment to a board via a lead.
Figure 46:
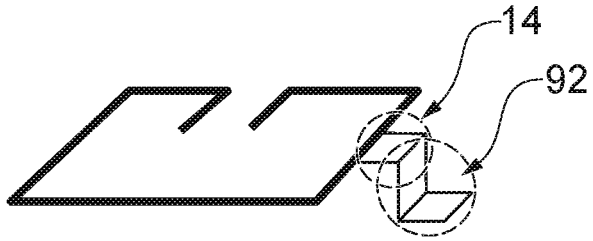
FIG. 46 is a perspective view showing another example configuration for connecting a split-ring resonator according to an embodiment to a board via a lead.
Figure 47:
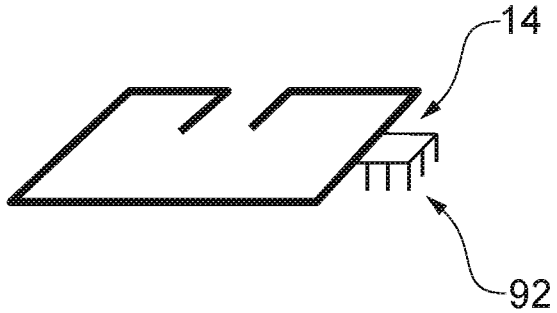
FIG. 47 is a perspective view showing still another example configuration for connecting a split-ring resonator according to an embodiment to a board via a lead.
Figure 48:
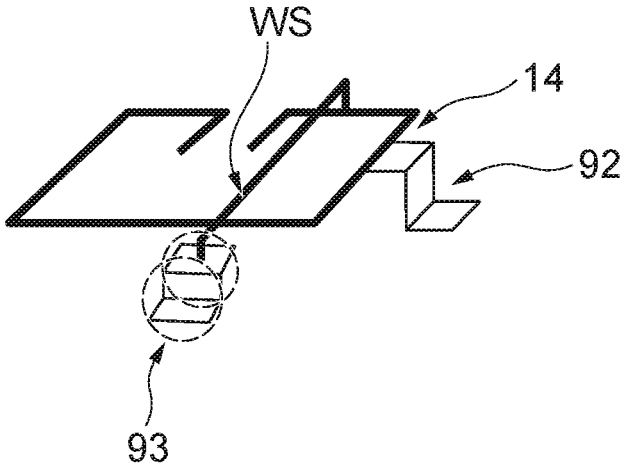
FIG. 48 is a perspective view showing yet another example configuration for connecting a split-ring resonator according to an embodiment to a board via a lead.
Figure 49:
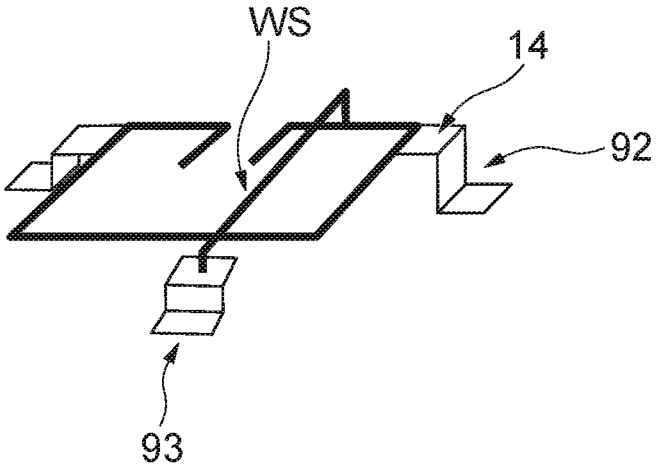
FIG. 49 is a perspective view showing further example configuration for connecting a split-ring resonator according to an embodiment to a board via a lead.
Figure 50:
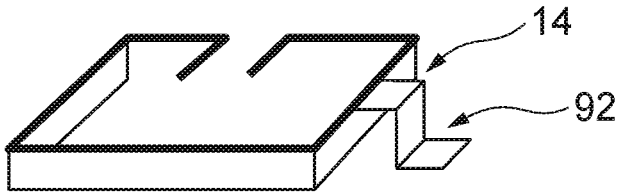
FIG. 50 is a perspective view showing still further example configuration for connecting a split-ring resonator according to an embodiment to a board via a lead.
Figure 51:
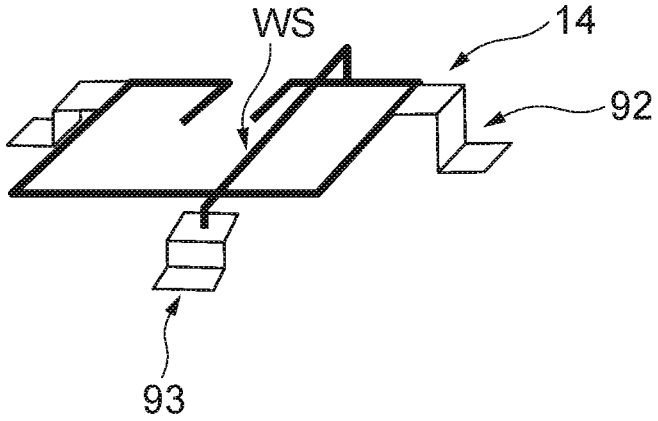
FIG. 51 is a perspective view showing yet further example configuration for connecting a split-ring resonator according to an embodiment to a board via a lead.
Figure 52:
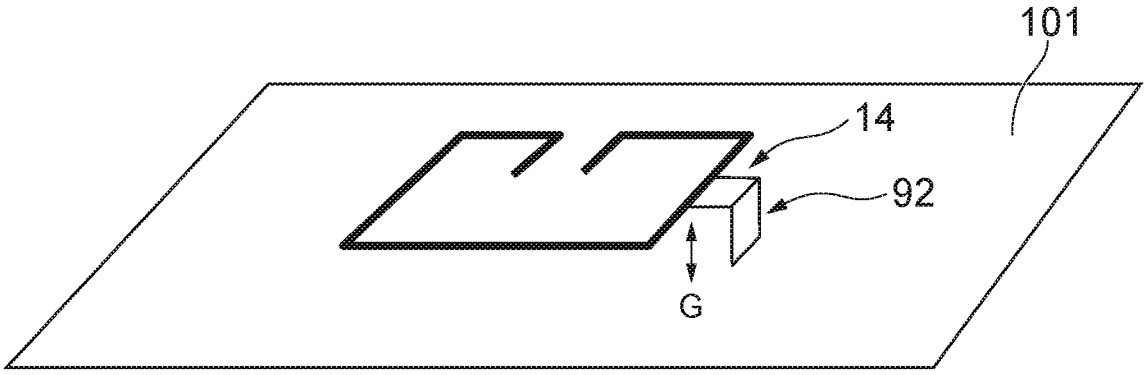
FIG. 52 is a perspective view showing yet further example configuration for connecting a split-ring resonator according to an embodiment to a board via a lead.
Figure 53:
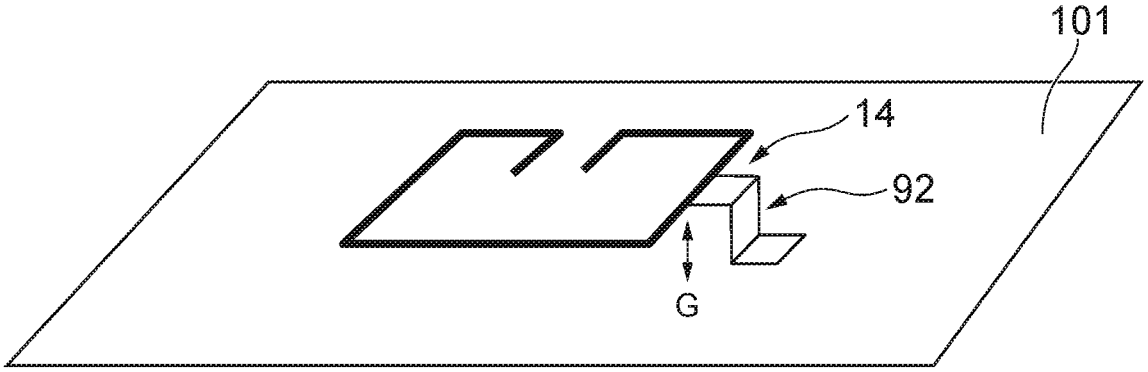
FIG. 53 is a perspective view showing yet further example configuration for connecting a split-ring resonator according to an embodiment to a board via a lead.
Figure 54:
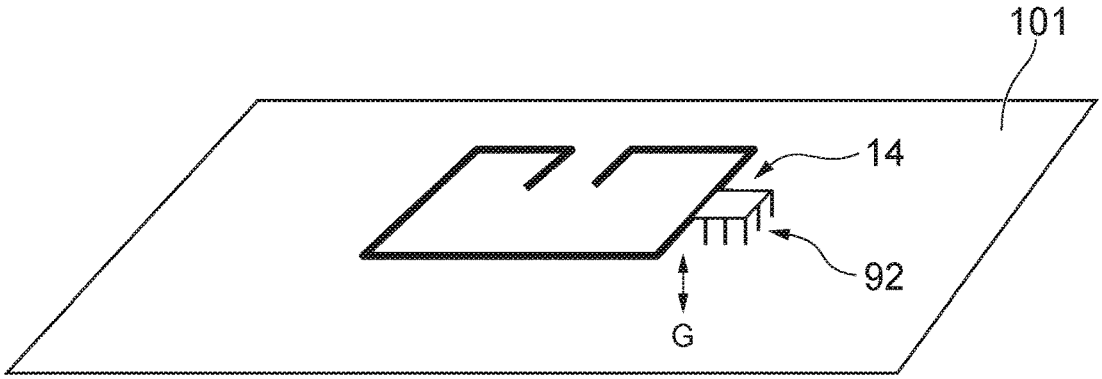
FIG. 54 is a perspective view showing yet further example configuration for connecting a split-ring resonator according to an embodiment to a board via a lead.
Figure 55:
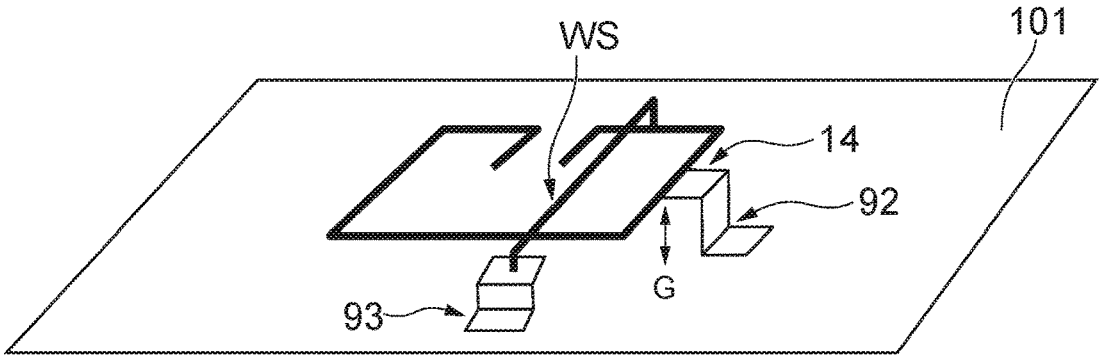
FIG. 55 is a perspective view showing yet further example configuration for connecting a split-ring resonator according to an embodiment to a board via a lead.
Figure 56:
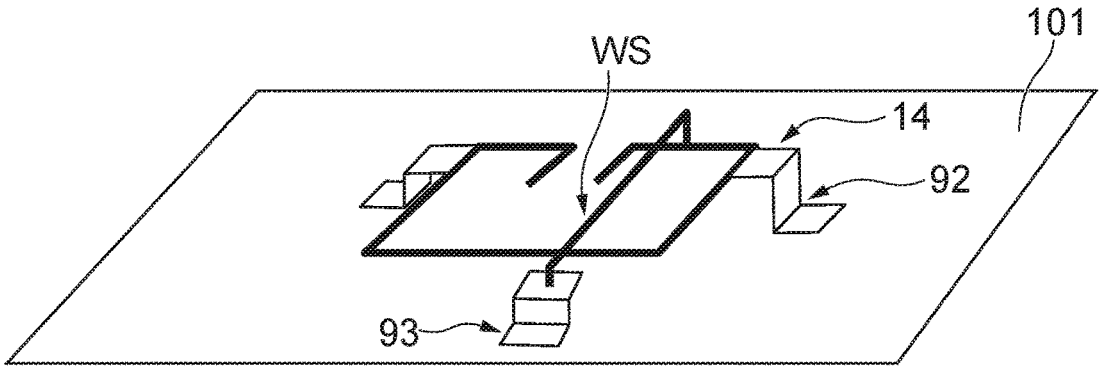
FIG. 56 is a perspective view showing yet further example configuration for connecting a split-ring resonator according to an embodiment to a board via a lead.
Figure 57:
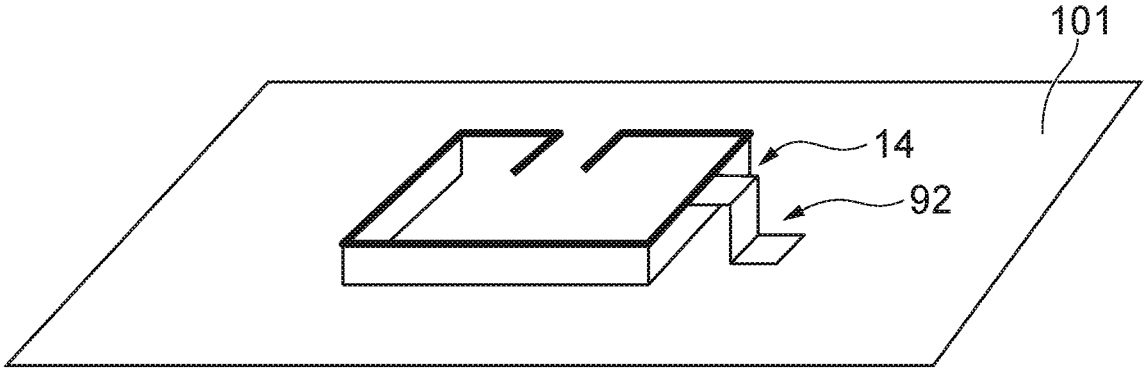
FIG. 57 is a perspective view showing yet further example configuration for connecting a split-ring resonator according to an embodiment to a board via a lead.
Figure 58:
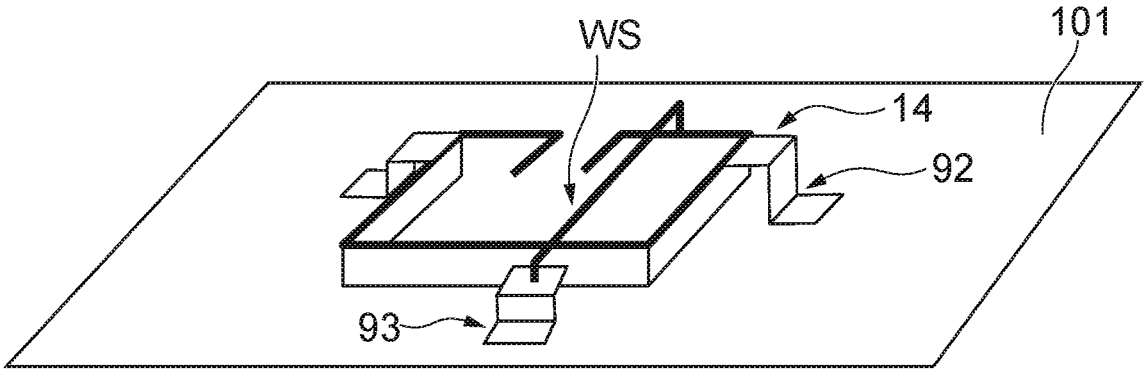
FIG. 58 is a perspective view showing yet further example configuration for connecting a split-ring resonator according to an embodiment to a board via a lead.

Hereafter, explanation will be made about a structure for connecting a split-ring resonator to a board, etc. by a lead. For example, the ground terminal 14 of the split-ring resonator may be connected by a lead 92 as shown in FIG. 45. For example, the ground terminal 14 of the split-ring resonator may be connected by the lead 92 as shown in FIG. 46. For example, the ground terminal 14 of the split-ring resonator may be connected by the lead 92 as shown in FIG. 47. For example, the ground terminal 14 of the split-ring resonator may be connected by the lead 92 as shown in FIG. 48. The feeding wire WS of the split-ring resonator may be connected by a lead 93. For example, as shown in FIG. 49, the ground terminal 14 of the split-ring resonator may be connected by the lead 92. The feeding wire WS of the split-ring resonator may be connected by the lead 93. For example, the ground terminal 14 of the split-ring resonator may be connected by the lead 92 as shown in FIG. 50. For example, as shown in FIG. 51, the ground terminal 14 and the feeding wire WS of the split-ring resonator may be connected by the lead 92 and the lead 93, respectively. For example, the ground terminal 14 of the split-ring resonator may be connected by the lead 92 so that the board 101 and the split-ring resonator have a gap G as shown in FIG. 52. For example, the ground terminal 14 of the split-ring resonator may be connected by the lead 92 so that the board 101 and the split-ring resonator have the gap G as shown in FIG. 53. For example, the ground terminal 14 of the split-ring resonator may be connected by the lead 92 so that the board 101 and the split-ring resonator have the gap G as shown in FIG. 54. For example, as shown in FIG. 55, the ground terminal 14 and the feeding wire WS of the split-ring resonator may be connected by the lead 92 and the lead 93, respectively, so that the board 101 and the split-ring resonator have the gap G. For example, as shown in FIG. 56, the ground terminal 14 and the feeding wire WS of the split-ring resonator may be connected by the lead 92 and the lead 93, respectively, so that the board 101 and the split-ring resonator. For example, the ground terminal 14 of the split-ring resonator may be connected to the board 101 by the lead 92 as shown in FIG. 57. For example, the ground terminal 14 of the split-ring resonator may be connected to the board 101 the lead 92 as shown in FIG. 58.

The present application is based on a Japanese patent application of JP2018-077203 filed on Apr. 12, 2018 before the Japan Patent Office, the content of which is entirely incorporated herein.

REFERENCE SIGNS LIST

11 split-ring resonator
12 split-ring
12*a* first conductor
12*b* second conductor
12*c* third conductor
12*d* fourth conductor
12*g* split portion
13 feeding terminal
14 ground terminal
15 chip body
15' printed circuit board
16 radiation conductor
16' radiation conductor
16L radiation conductor
16R radiation conductor
17 radiation conductor
17' radiation conductor
21 split-ring resonator
31 split-ring resonator
41 split-ring resonator
44 ground terminal
51 split-ring resonator
61 split-ring resonator
71 split-ring resonator
81 split-ring resonator
91 split-ring resonator
92 lead
101 board
101*a* opening
101*g* ground pattern
101*g'* ground pattern
101*r* reception terminal
102 connector
102*c* dielectric cap
102*g* ground pattern
102*s* feeding pattern
102*r* reception terminal
103 main circuit board
103*g* main ground pattern
114 projecting pattern
214 exposed pattern
C point
f0 resonance frequency
Ig return current
Ir current
Is fed current
L straight-line
M straight-line
m line segment
RD lower section
RL left section
RR right section
RU upper section
SR solder
WR wire
WS feeding wire

The invention claimed is:

1. A split-ring resonator comprising:

a split-ring comprising a conductor having a substantially ring shape with a split formed therein;

a first ground terminal which is separated from and electrically connectable to a ground pattern; and a second ground terminal which is separated from and electrically connectable to the ground pattern, wherein:

the first ground terminal is located on a section where the split exists as viewed from a straight-line L;

on the straight-line L, a point C exists, the point C being a center of the conductor;

the straight-line L is perpendicular to a line segment which connects the point C and the split to each other;

the first ground terminal is located at a first corner of the split-ring resonator; and the second ground terminal is located on the section where the split exists as viewed from the straight-line L and is located at a second corner of the split-ring resonator.

2. The split-ring resonator as recited in claim 1, wherein:

the split-ring resonator comprises a third ground terminal which is separated from the ground pattern; and the third ground terminal is located on a section where the split does not exist as viewed from the straight-line L.

3. The split-ring resonator as recited in claim 1, wherein:

all ground terminals including the first ground terminal and the second ground terminal are located on one of opposite sections across a straight-line M; and the straight-line M is a straight-line including the line segment which connects the point C and the split to each other.

4. The split-ring resonator as recited in claim 3, further comprising a radiation conductor located on a section where the first ground terminal does not exist as viewed from the straight-line M.

5. A board comprising a terminal connectable to one of the first ground terminal and the second ground terminal of the split-ring resonator as recited in claim 1.

6. A connector comprising a terminal connectable to one of the first ground terminal and the second ground terminal of the split-ring resonator as recited in claim 1.

* * * * *